US010993310B2

(12) United States Patent
Kephart

(10) Patent No.: US 10,993,310 B2
(45) Date of Patent: Apr. 27, 2021

(54) COMPACT SRF BASED ACCELERATOR

(71) Applicant: Fermi Research Alliance, LLC, Batavia, IL (US)

(72) Inventor: Robert Kephart, Batavia, IL (US)

(73) Assignee: Fermi Research Alliance, LLC, Batavia, IL (US)

( * ) Notice: Subject to any disclaimer, the term of this patent is extended or adjusted under 35 U.S.C. 154(b) by 22 days.

(21) Appl. No.: 16/502,045

(22) Filed: Jul. 3, 2019

(65) Prior Publication Data

US 2020/0015347 A1 Jan. 9, 2020

Related U.S. Application Data

(63) Continuation of application No. 16/054,942, filed on Aug. 3, 2018, now Pat. No. 10,390,419, which is a continuation of application No. 15/280,107, filed on Sep. 29, 2016, now Pat. No. 10,070,509.

(60) Provisional application No. 62/234,475, filed on Sep. 29, 2015.

(51) Int. Cl.
*H05H 7/20* (2006.01)
*H05H 7/22* (2006.01)

(52) U.S. Cl.
CPC ..... *H05H 7/22* (2013.01); *H05H 7/20* (2013.01)

(58) Field of Classification Search
CPC ..... H05H 7/20; H05H 7/22
USPC ..... 313/22
See application file for complete search history.

(56) References Cited

U.S. PATENT DOCUMENTS

| | | | | |
|---|---|---|---|---|
| 5,162,698 | A * | 11/1992 | Kato | H01J 23/05 313/346 R |
| 6,084,340 | A * | 7/2000 | Bachmann | H01J 1/308 313/309 |
| 6,172,463 | B1 | 1/2001 | Cutler | |
| 7,140,771 | B2 | 11/2006 | Leek | |
| 8,159,158 | B2 | 4/2012 | Popovic | |
| 8,674,630 | B1 | 3/2014 | Cornelius | |
| 8,779,697 | B2 | 7/2014 | Baurichter et al. | |
| 9,398,681 | B2 | 7/2016 | Tantawi et al. | |
| 2004/0085096 | A1 | 5/2004 | Ward et al. | |
| 2004/0092050 | A1 * | 5/2004 | Shuy | H01J 9/025 438/20 |

(Continued)

FOREIGN PATENT DOCUMENTS

| | | | |
|---|---|---|---|
| WO | 2013090342 | A1 | 6/2013 |
| WO | 2016043783 | A1 | 3/2016 |

OTHER PUBLICATIONS

U.S. Appl. No. 14/689,695, dated Aug. 17, 2015, Kephart.

*Primary Examiner* — Christopher M Raabe
(74) *Attorney, Agent, or Firm* — Loza & Loza LLP; Kevin L. Soules

(57) ABSTRACT

An accelerator comprising at least one accelerator cavity, an electron gun, at least one cavity cooler configured to at least partially encircle the accelerator cavity, a cooling connector, an intermediate conduction layer formed between the at least one cavity cooler and the at least one accelerator cavity configured to facilitate thermal conductivity between the cavity cooler and the accelerator cavity, a mechanical support connected to the accelerator cavity via at least one endplate and configured for stabilizing the accelerator cavity, and a refrigeration source for providing refrigerant via the cooling connector to the at least one cavity cooler.

11 Claims, 21 Drawing Sheets

(56) References Cited

U.S. PATENT DOCUMENTS

| | | | | |
|---|---|---|---|---|
| 2006/0033417 | A1* | 2/2006 | Srinivasan-Rao | H01J 3/021 313/399 |
| 2006/0227830 | A1* | 10/2006 | Keady | F03H 1/0081 372/39 |
| 2008/0068112 | A1 | 3/2008 | Yu et al. | |
| 2010/0219776 | A1* | 9/2010 | Liu | H05H 15/00 315/503 |
| 2012/0326636 | A1 | 12/2012 | Eaton et al. | |
| 2013/0229109 | A1* | 9/2013 | Teryaev | H01J 25/10 315/5.39 |
| 2016/0035531 | A1 | 2/2016 | Lunin et al. | |
| 2016/0203937 | A1* | 7/2016 | Sumant | H01J 9/025 313/542 |

* cited by examiner

500

COMPACT SRF BASED ACCELERATOR

CROSS REFERENCE TO RELATED PATENT APPLICATIONS

The present application is a continuation of nonprovisional patent application Ser. No. 16/054,942 titled "Compact SRF Based Accelerator," filed Aug. 3, 2018. U.S. patent application Ser. No. 16/054,942 is herein incorporated by reference in its entirety.

U.S. patent application Ser. No. 16/054,942 is a continuation of nonprovisional patent application Ser. No. 15/280,107 titled "Compact SRF Based Accelerator," filed Sep. 29, 2016. U.S. patent application Ser. No. 15/280,107 is herein incorporated by reference in its entirety.

U.S. patent application Ser. No. 15/280,107 claims the priority and benefit under 35 U.S.C. § 119(e) of U.S. Provisional Patent Application Ser. No. 62/234,475 filed Sep. 29, 2015, entitled "COMPACT SRF BASED ACCELERATOR." U.S. Provisional Patent Application Ser. No. 62/234,475 is herein incorporated by reference in its entirety.

STATEMENT OF GOVERNMENT RIGHTS

The invention described in this patent application was made with Government support under the Fermi Research Alliance, LLC, Contract Number DE-AC02-07CH11359 awarded by the U.S. Department of Energy. The Government has certain rights in the invention.

TECHNICAL FIELD

Embodiments are generally related to the field of accelerators. Embodiments are further related to electric lamp and discharge devices. Embodiments are additionally related to linear accelerators or linacs.

BACKGROUND

Accelerators originally developed for scientific applications are currently used for broad industrial, medical, and security applications. Over 30,000 accelerators find some use in producing over $500 billion per year in products and services, creating a major impact on the economy. Industrial accelerators must be cost effective, simple, versatile, efficient, and robust.

Examples of industrial applications include radiation cross linking of plastics and rubbers, creation of pure materials with surface properties radically altered from the bulk, modification of bulk or surface optical properties of materials, radiation driven chemistry, food preservation, sterilization of medical instruments, sterilization of animal solid or liquid waste, and destruction of organic compounds in industrial wastewater effluents.

Many of the above industrial applications require high-average beam power. A major design choice for high-average power, compact superconducting radio frequency (SRF) accelerators is the choice of radio frequency (RF). As the frequency goes up, the size and weight of an SRF accelerator decreases. However, as the frequency goes up, the SRF cryogenic cooling requirements grow with the square of the frequency leading to the need for large cryogenic systems that, without additional technological advances, outpace the gains in going to higher frequencies. Until recently, the mitigation approach was to adopt low frequencies (e.g., ~350 MHz or lower) that in turn lead to large physical size and weight for the cavities, cryomodule, and the required radiation shielding.

Accordingly, methods and systems providing improved compact SRF based accelerators are required that avoid disadvantages associated with prior art approaches.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide a method and system for an accelerator.

It is another aspect of the disclosed embodiments to provide a method and system for electric lamp and discharge devices.

It is another aspect of the disclosed embodiments to provide methods, systems, and apparatuses for linear accelerators.

It is yet another aspect of the disclosed embodiments to provide methods, systems, and apparatuses for compact SRF based accelerators.

The aforementioned aspects and other objectives and advantages can now be achieved as described herein. Systems and methods for an accelerator comprising at least one accelerator cavity, an electron gun, at least one cavity cooler configured to at least partially encircle the accelerator cavity, a cooling connector, an intermediate conduction layer formed between the at least one cavity cooler and the at least one accelerator cavity configured to facilitate thermal conductivity between the cavity cooler and the accelerator cavity, a mechanical support connected to the accelerator cavity configured for stabilizing the accelerator cavity, and a refrigeration source for providing cooling via the cooling connector to the at least one cavity cooler.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware, or any combination thereof (other than software per se). The following detailed description is therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment, and the phrase "in another embodiment" as used herein does not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Figure 1:
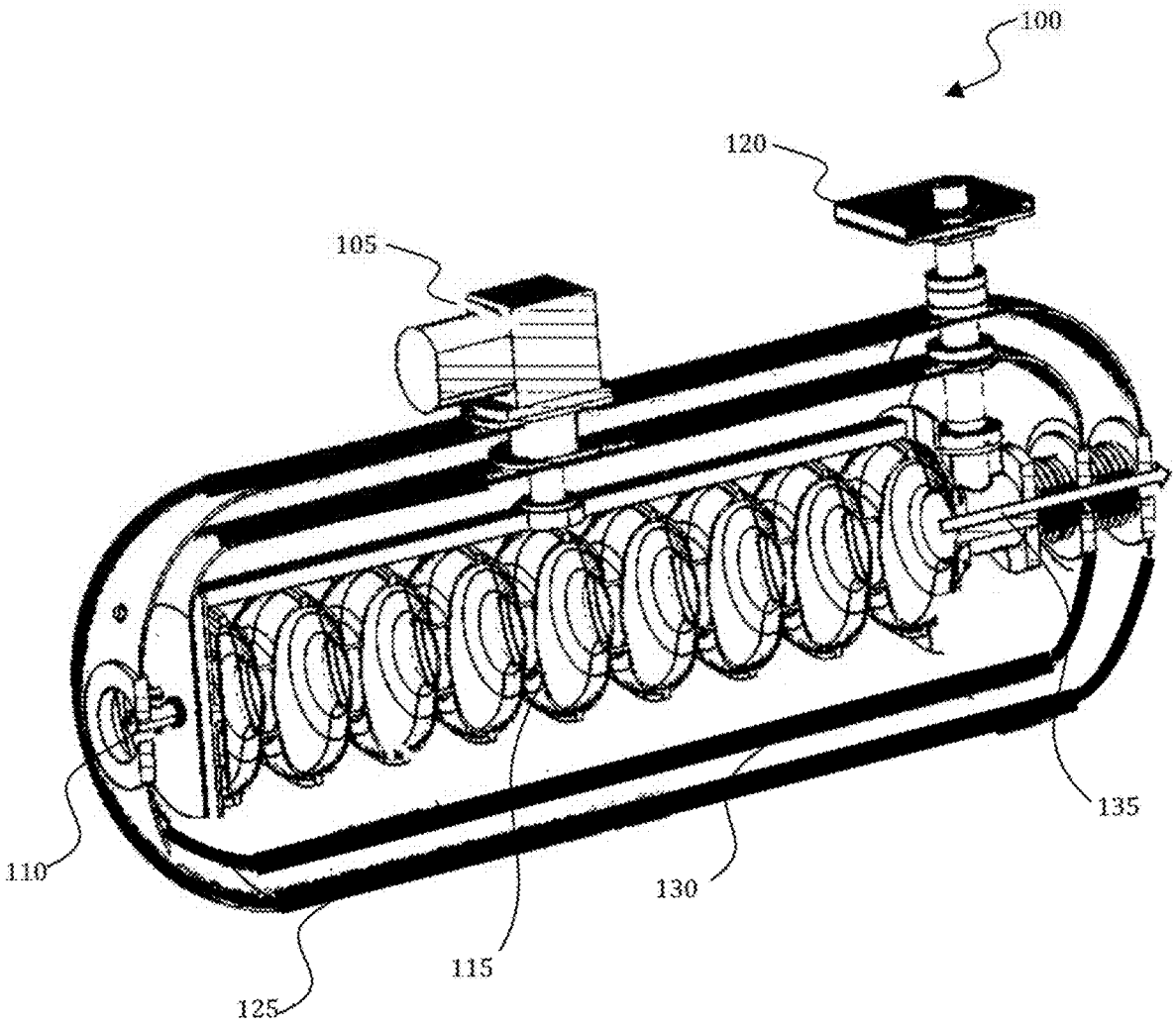
FIG. 1 illustrates an embodiment of a compact SRF based accelerator.

FIG. 1 illustrates an exemplary embodiment of a compact SRF based accelerator. Recent transformational, technological advances in SRF and peripheral equipment pave the way to create a viable, compact, robust, high-power, high-energy, electron-beam, or x-ray source. When these advances are integrated into a single design, they enable an entire new class of compact, mobile, high-power electron accelerators. Taken together these innovative technologies enable a new class of compact, simple, SRF based accelerators for industrial, scientific, non-destructive testing, and security applications.

In certain embodiments, niobium surface processing techniques "N-doping" can be employed to dramatically reduce the cryogenic refrigeration requirement for 650 MHz and 1.3-GHz SRF cavities at 1.8 Kelvin. These embodiments can also significantly reduce losses at 4.4 Kelvin and can be further optimized for operations at this temperature.

1.3-GHz single cell niobium cavities coated with $Nb_3Sn$ can be operated with gradients of 10 Megavolts/m with a quality factor ($Q_0$) of $2\times10^{10}$ at a temperature of 4.2 K. A nine cell cavity with this $Q_0$ could be operated with Continuous Wave (CW) RF power dissipating 3.5 W, in range to be cooled by a single 5 W commercial cryocooler. It is possible to further improve this performance with processes similar to N-doping.

With reduced dynamic heating due to the advancements highlighted above, in an embodiment, conduction cooling of the SRF cavity resulting in a drastically simplified cryogenic system requiring no gas or liquid Helium inventory can be achieved. In such an embodiment, the vacuum vessel can serve as part of the radiation shield leading to additional reductions in size, weight, and overall system cost.

In certain embodiments, a single, injection-locked, 1-kW, magnetron can provide excellent phase and amplitude control at 2.45-GHz on a single-cell SRF cavity. Such a method can be scaled to other frequencies such as 1.3-GHz and used for multi-cell cavities. Using magnetrons to drive a narrow-band load as a 1.3 GHz SRF cavity can dramatically lower the cost and improve the efficiency of the RF system. This technology can reduce the cost of RF power for compact SRF accelerators by a factor of 5 while at the same time achieving efficiencies in excess of 80%. This also provides significant size, weight, and cost reductions in both power and cooling systems for the embodiments disclosed herein, compared to current solid-state or klystron solutions.

An SRF gun cavity with an integrated thermionic cartridge or Field-Emission (FE) electron cathode provides integration of the gun cavity into the accelerating cavity creating a very short and compact accelerator. Small physical size is a key feature of the present embodiments as one aspect of the disclosed embodiments includes mobile applications of the accelerator which requires limiting the weight of radiation shielding. In such embodiments, it is critical that the cathode can operate at a high $Q_0$ SRF cavity based gun without contamination of the cavity's internal surface.

A robust and very low heat leak fundamental RF power coupler capable of handling many 10's of KW of RF power may be included in the disclosed embodiments. In an embodiment, an RF shield may be incorporated to decrease the magnetic field at the outer wall of the coupler eliminating the need for copper plating and shunting dynamic losses out to an intermediate temperature (e.g., 60 K) vs. into the SRF cavity at 4.5 K. This dramatically reduces static heat loads and can effectively eliminate dynamic losses to 4 K.

In certain embodiments, these innovations can be integrated into an SRF based linear accelerator in order to create a high-power, high-energy electron source that is compact, efficient, and simple enough for industrial applications. One embodiment of an accelerator may comprise a single, 9-cell, 1.3-GHz cavity with its first cell modified to be the gun, operated at 4.5 K, and powered by a CW injection-locked magnetron RF source with a thermionic cathode as the source of the electrons. The cavity may comprise pure Niobium with surface processing including treatment to provide a high $Q_0$ optimized for 4.5 K operation. Users will adjust the beam energy to ~7 MeV and the RF duty factor to ||5% by making long pulses to limit dynamic heating to an average of about 3.5 W. It is estimated that ~3 kW of average beam power is achievable in this mode. The cavity will be housed in a low heat leak cryostat and conduction cooled via one or more 5 W commercial cryocoolers such that the system requires no gas or liquid Helium inventory. In an alternative embodiment, this cavity will be replaced with a similar one coated with $Nb_3Sn$ with processing optimized for 4.5 K operation. The $Nb_3Sn$ coated cavity will enable true CW operation at 10 MeV and substantially higher average beam power approximately 10's of KW, limited primarily by the ability to control beam losses to cold cavity surfaces.

A diagram of an accelerator 100 in accordance with the disclosed embodiments is shown in FIG. 1. While the implementation in FIG. 1 will be a useful platform technology for many applications, it is important to understand that this is but one embodiment of an entirely new class of simple SRF accelerators. For example, other embodiments may employ similar techniques to achieve higher beam powers (e.g., using a 650 MHz elliptical cavity with a larger aperture and even lower cryogenic losses) or multi-cavity system to achieve higher beam energy. The sections that follow describe in more detail some of the key technologies required using the compact 1.3 GHz design shown in FIG. 1 as the example. Embodiments of the accelerator 100 include a cryo-cooler 105, an ILC cavity 115 with an integrated electron gun 110, and an RF power coupler 120. A thermal radiation and magnetic field shield 125 and vacuum vessel/x-ray shield 130 can also be incorporated in the accelerator 100. Arrow 135 illustrates the electron beam exit to an x-ray target.

Heating in an SRF cavity is the result of non-zero resistance due to scattering of unpaired electrons excited by the radio frequency alternating fields. These so called "dynamic losses" can be reduced by one of several methods:

1) Improved cavity surface processing to decrease surface impedance. This is equivalent to increasing the cavity quality factor ($Q_0$) defined as $Q_0=U/d_U$, where U is the cavity stored energy and $d_U$ is the energy lost per RF cycle as heat at the desired operating temperature and accelerating field;

2) Lower the cavity operating frequency since an important part of dynamic losses due to unpaired electron scale as the frequency squared;

3) Lower the operating temperature resulting in fewer unpaired electrons (e.g., 1.8 K for Nb), but with increasingly complex refrigeration requirements; or 4) Use a superconductor with a higher transition temperature ($T_c$) such as $Nb_3Sn$.

Methods (2) and (3) above are counter to the goal of a simple, low cost, compact, high-average power industrial accelerators. Therefore, these embodiments disclosed herein leverage methods that improve the $Q_0$ for smaller higher frequency SRF cavities as well as utilize materials with higher transition temperatures. The very high $Q_0$ can result in dynamic heat loads per cavity under 5 W at 4.5 K. This introduces the embodiments which make use of pulse tube refrigerators (e.g., cryo-cooler 105) eliminating the need for large 4K refrigerators, pressure vessels, complex gas, or liquid helium inventory management systems to maintain the cavity at operating temperature.

Figure 2:
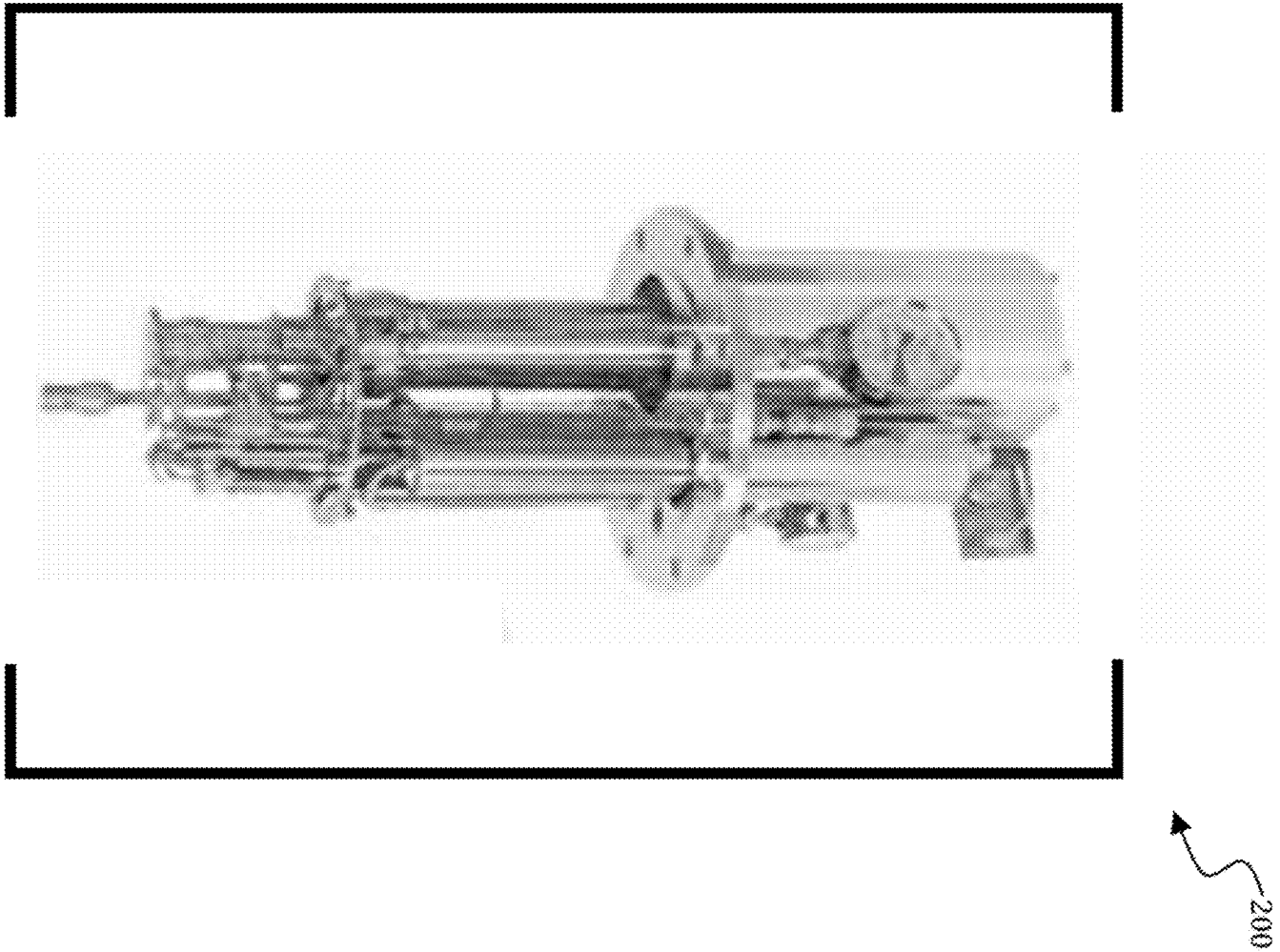
FIG. 2 illustrates an advanced 4K cryo-cooler for use with the compact SRF based accelerator.

FIG. 2 illustrates a picture 200 of an advanced 4K cryo-cooler 105 for use with the compact SRF based accelerator 100. It should be appreciated that other cryo-cooler or cooling application may alternatively be used in certain embodiments. Advanced 4K cryocoolers can provide up to 5 Watts of refrigeration at 4.2 K in very compact, simple, reliable package. Note that in this embodiment, the entire cryocooler system weight can be approximately 600 lbs. for a 5 W system, which enables compact mobile SRF accelerator applications.

In certain embodiments, a Niobium surface processing technique known as "N-doping" can be employed to consistently provide $Q_0$ performance on, for example, a 9-cell 1.3 GHz cavity. In such embodiments, the average achievable $Q_0$ at 1.8 K exceeds $3\times10^{10}$. Embodiments which take advantage of cavities prepared in this way and operated at 4.4 K can achieve a $Q_0$ of $6\text{-}7\times10^8$ at 6 MeV/m. Holding with the example, a 9-cell cavity prepared in this way and operated at approximately 7 MV/m with CW RF leads to cryogenic losses of ~70 W. If such a cavity were operated in pulsed mode with 5% duty factor, the refrigeration requirement would be approximately 3.5 W, in range for a commercial 5 W cryocooler.

Figure 3:
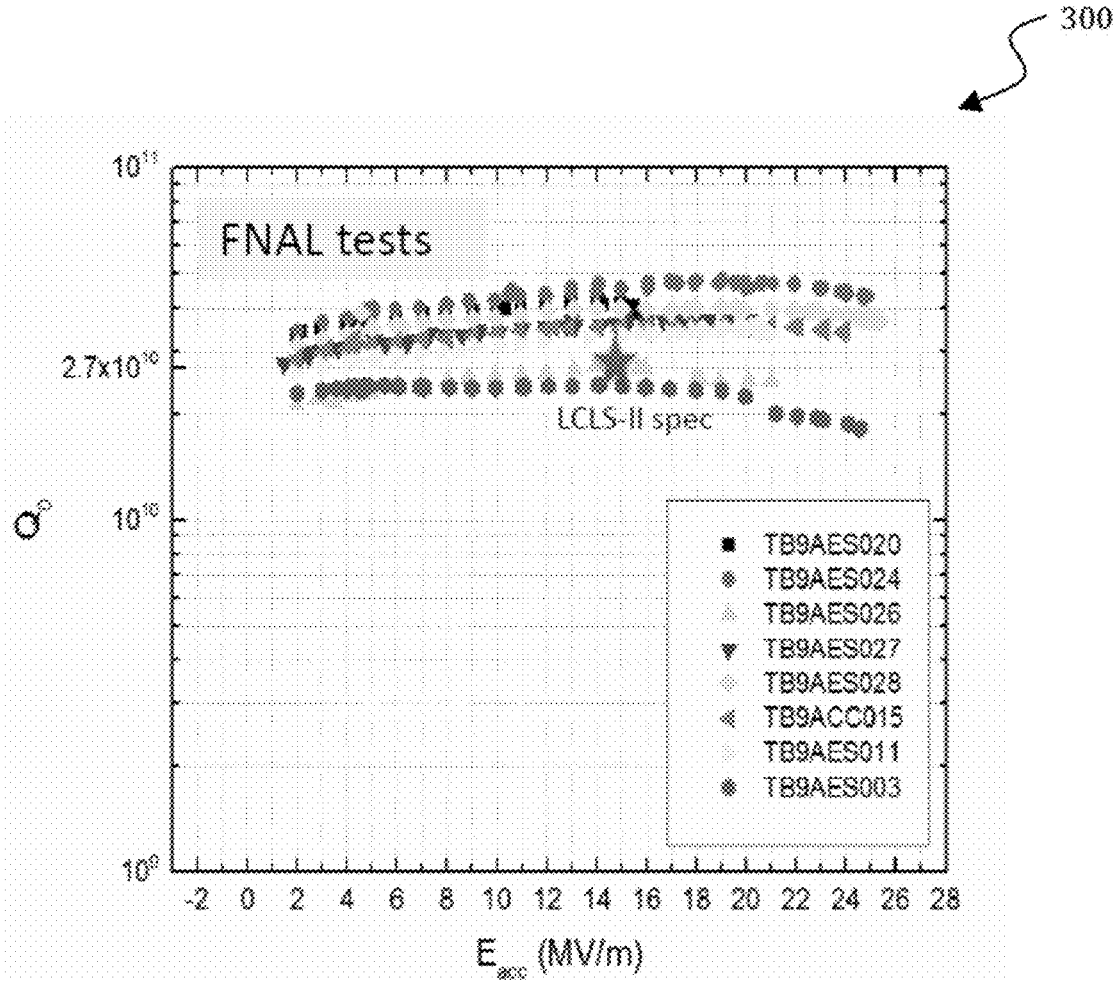
FIG. 3 illustrates a graph of $Q_0$ vs. $E_{acc}$ for N-doped 1.3 GHz 9-cell cavities.

FIG. 3 illustrates a chart 300 of $Q_0$ vs. $E_{ACC}$ for N-doped 1.3 GHz 9-cell cavities in accordance with the disclosed embodiments. The average $Q_0$ is $>3\times10^{10}$.

Figure 4:
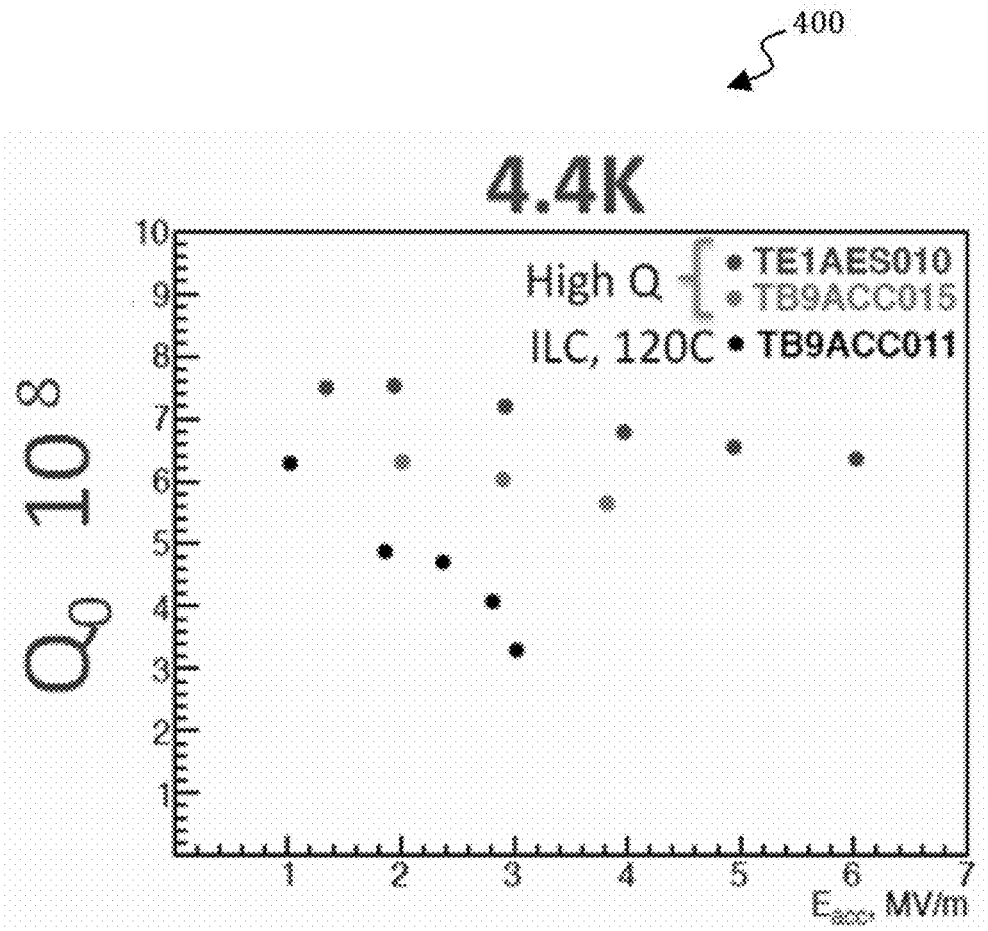
FIG. 4 illustrates a graph of $Q_0$ vs. $E_{acc}$ for non-optimized N-doped 1.3 GHz cavities at 4.4 K.

FIG. 4 illustrates a chart 400 of $Q_0$ vs. $E_{ACC}$ for non-optimized N-doped 1.3 GHz cavities at 4.4 K in accordance with the disclosed embodiments. The $Q_0$ falls slowly with gradient and is approximately $6\text{-}7\times10^8$ at 6 MV/m.

For Continuous Wave (CW) operation, it would be much better to employ a cavity with an RF surface made using a superconductor with a higher transition temperature such as $Nb_3Sn$, which has a superconducting transition temperature of 18 K. The higher transition temperature vs. $T_C$ of 9 K for pure Nb means that at temperatures near the helium boiling point at atmospheric pressure (4.2 K), an SRF cavity surface coated with $Nb_3Sn$ will have a much lower number of unpaired electrons. This leads to measured $Q_0$ values higher by a factor of >30.

Figure 5:
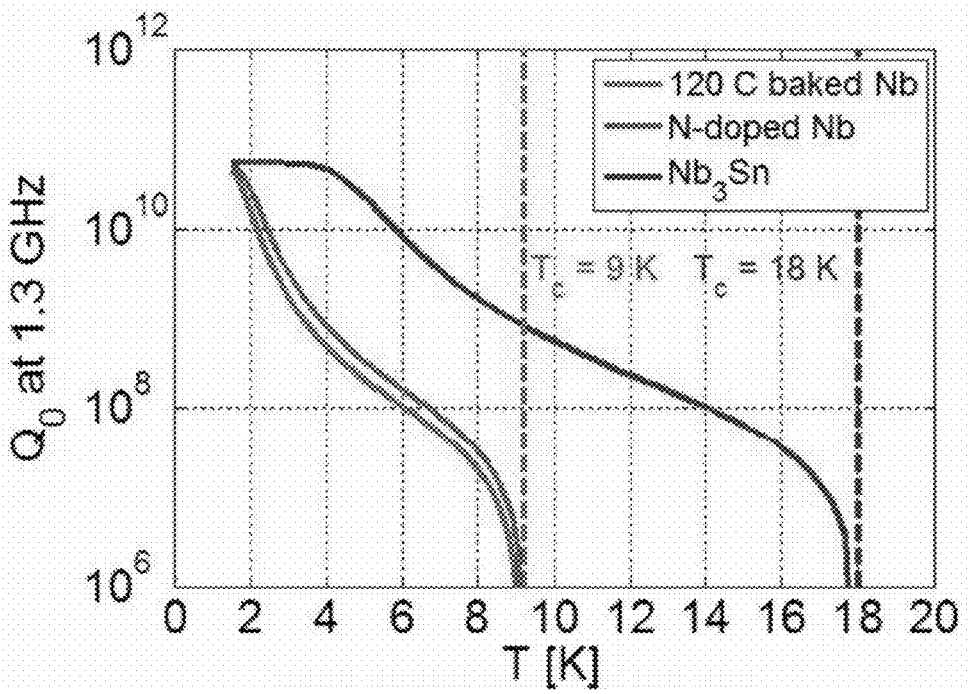
FIG. 5 illustrates a graph of a calculated $Q_0$ comparison between a pure Nb cavity and an Nb cavity coated with $Nb_3Sn$.

FIG. 5 illustrates a graph 500 of a calculated $Q_0$ comparison between a pure Nb cavity and an Nb cavity coated with $Nb_3Sn$. Note that $Q_0$ increases by a factor of approximately 30 at approximately 4.2 K.

Since the cryogenic heat load is dramatically reduced with a $Nb_3Sn$ coated cavity, it will become possible to operate the cavity at 100% RF duty factor even at temperatures of approximate 4.5 K allowing the disclosed accelerators to produce a beam continuously.

In an embodiment, a single cell 1.3 GHz elliptical Nb cavity can be coated with $Nb_3Sn$. Such a cavity can provide a $Q_0$ (approximately $2\times10^{10}$) at 14 MV/m. A 9-cell cavity prepared in this way can dissipate only 3.5 W of dynamic losses into the cryo-system at 10 MV/M accelerating gradient. If operated with 1 mA of average beam current, this means approximately 10 kW of beam power. If the current could be increased to 5 mA, then 50 KW of beam power would be produced. Care in cavity processing can lead to negligible field emission at this gradient such that beam losses to the cryogenic cavity become the new limiting feature for the accelerator.

Figure 6:
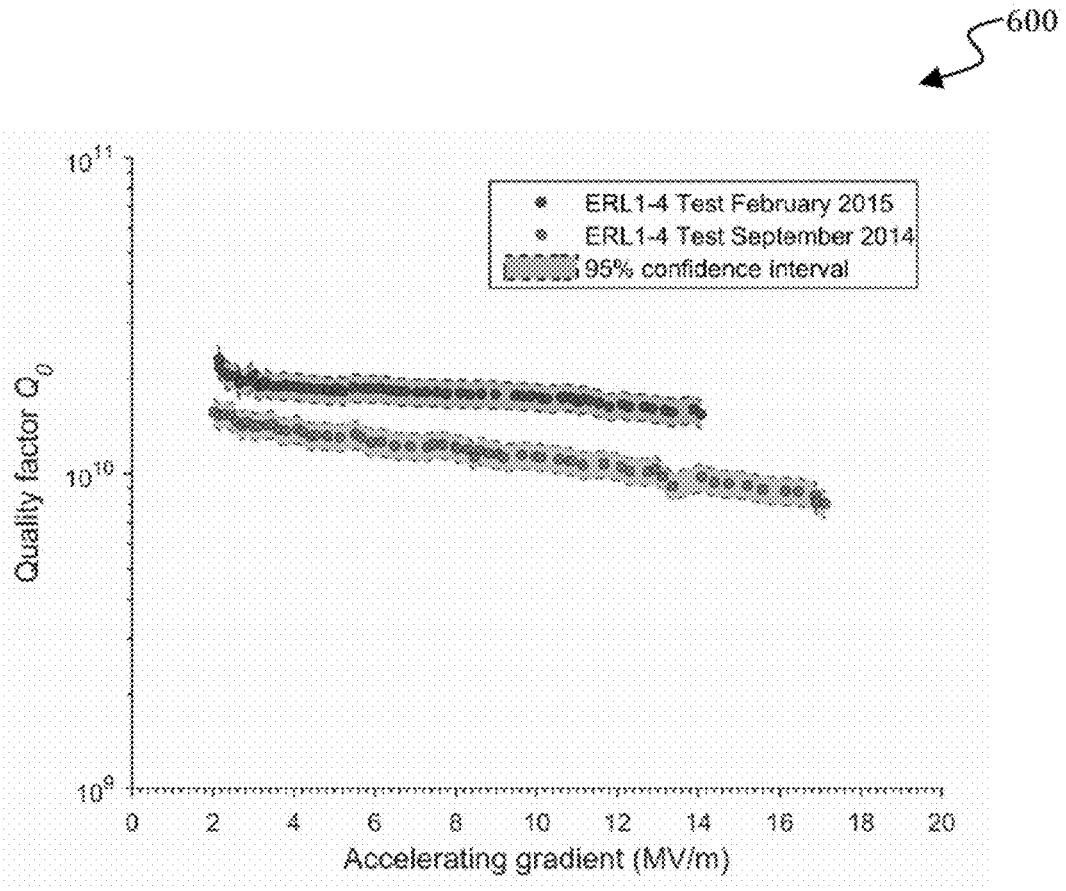
FIG. 6 illustrates a graph of $Q_0$ vs. E for an Nb 1.3 GHz single cell cavity coated with $Nb_3Sn$.

FIG. 6 illustrates a graph 600 of $Q_0$ vs. E for an Nb 1.3 GHz single cell cavity coated with $Nb_3Sn$ in accordance with an embodiment. The figure illustrates alternative cool-down procedures, certain of which result in a higher quality factor and reduced Q-slope.

Figure 7:
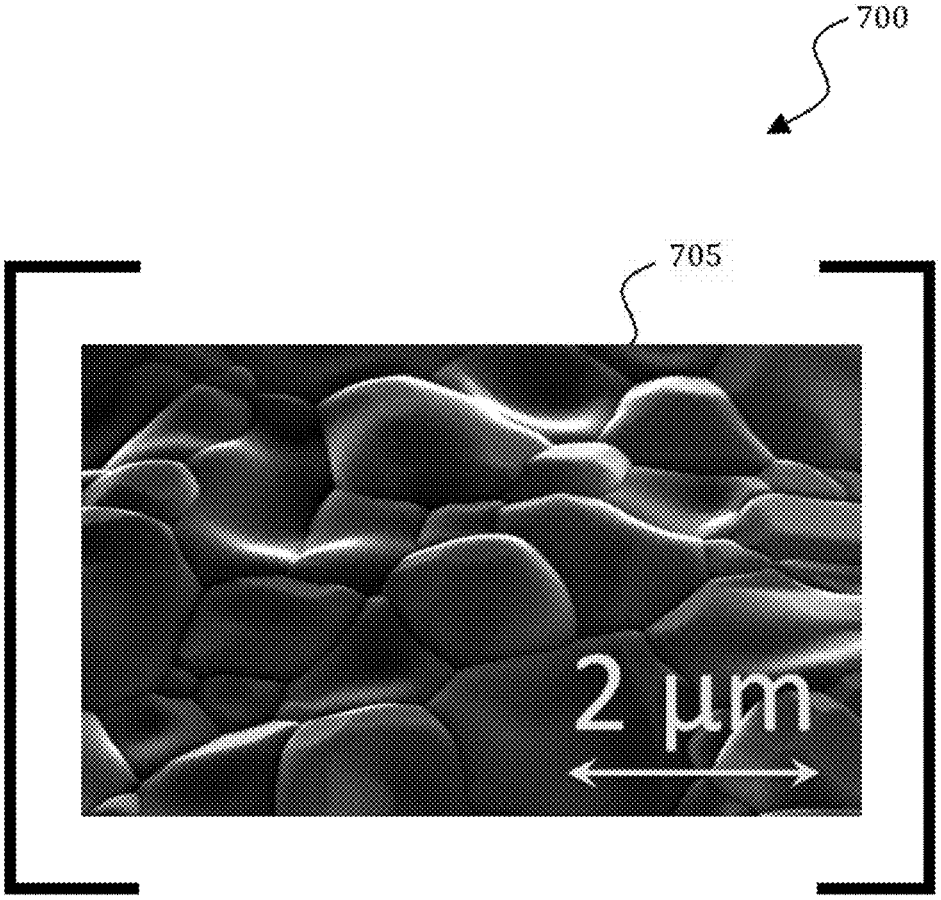
FIG. 7 illustrates a SEM image of $Nb_3Sn$ surface.

FIG. 7 illustrates a SEM image 700 of $Nb_3Sn$ surface 705. The SEM indicates appropriate grain size and texture of such a surface in accordance with the disclosed embodiments.

An electron gun and the cathode system are critical components for stable intensity and high-average powers in the disclosed embodiments. The basic gun design can provide short bunches and thus small current interception. It also employs features of other successful RF and SRF guns. However, the embodiment of FIG. 1 integrates the gun cavity into the first cell of a standard ILC/XFEL 9 cell 1.3 MHz cavity to form an 8.5 cell accelerating structure. This is preferable for a compact design.

Figure 8:
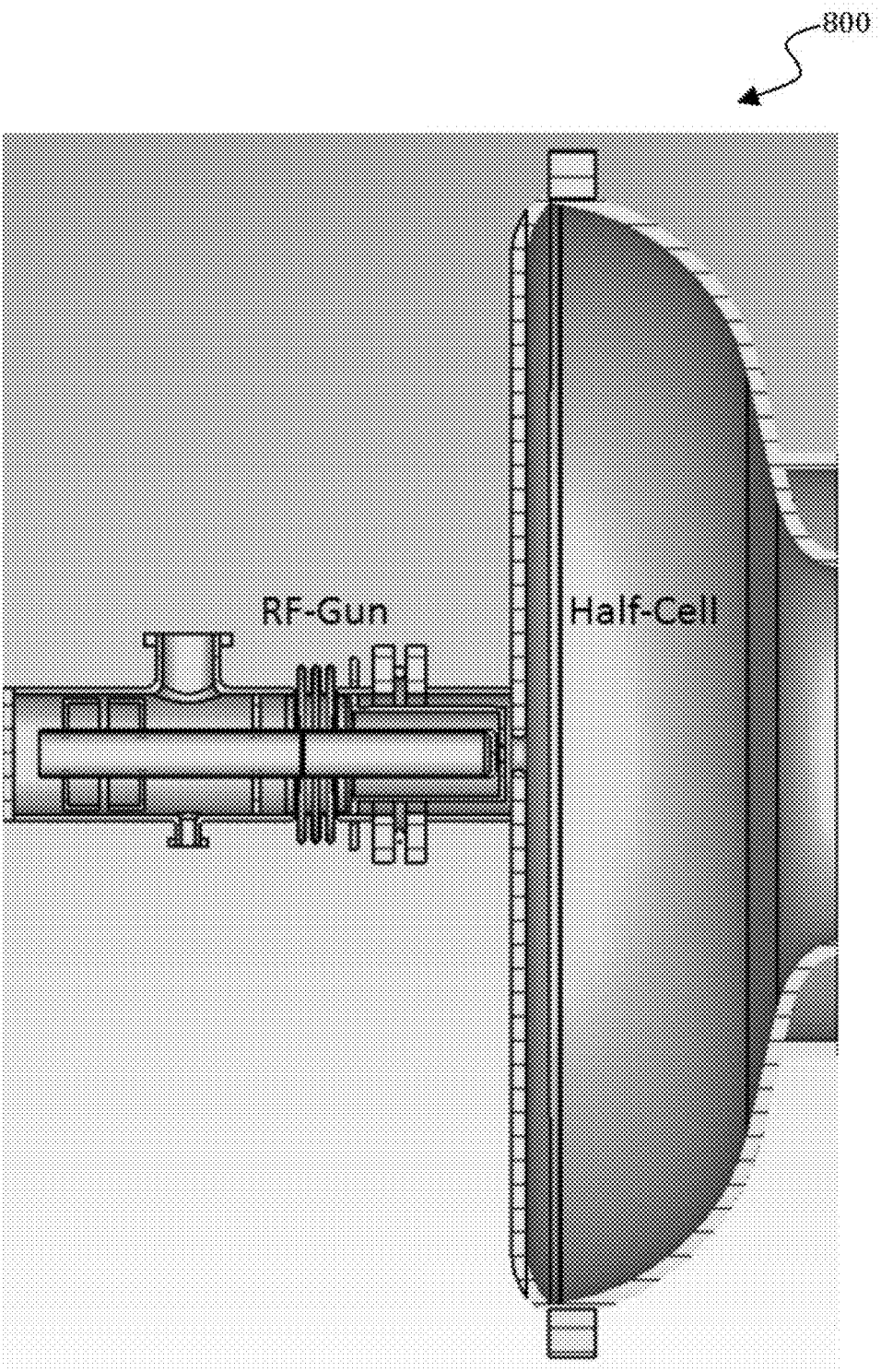
FIG. 8 illustrates an electron gun with thermionic cathode that can be integrated into a multi-cell elliptical cavity.

FIG. 8 illustrates a schematic of an SRF gun 800 that can be integrated into a 1.3 GHz 9-cell elliptical cavity in accordance with the disclosed embodiments. The cathode shown is a thermionic cartridge cathode, but the assembly is removable allowing both optimization and implementation of various cathode technologies. The thermionic cathode consumes 3 W leading to an estimated heat load from the cathode to the cavity cold surface at 4.5 K of 0.1 W.

In certain embodiments, a cathode can be fabricated from an array of field emitters (FE). This allows the cathode to operate near the temperature of the SRF cavity minimizing heat sources into the cryogenic system. There are several approaches for FE cathodes. An embodiment can take advantage of the creation of cold Field Emission (FE) electron cathodes based on arrays of metallic nanowires; a design based on robust carbon nanotubes; and a method using nano-diamonds.

Since material evaporated from the cathode can contaminate the interior of the SRF cavity reducing the cavity $Q_0$, various embodiments may employ cathode options using a single cell, high $Q_0$, SRF gun cavity and down select based on both emission characteristics and minimal contamination to SRF surfaces.

Figure 9:
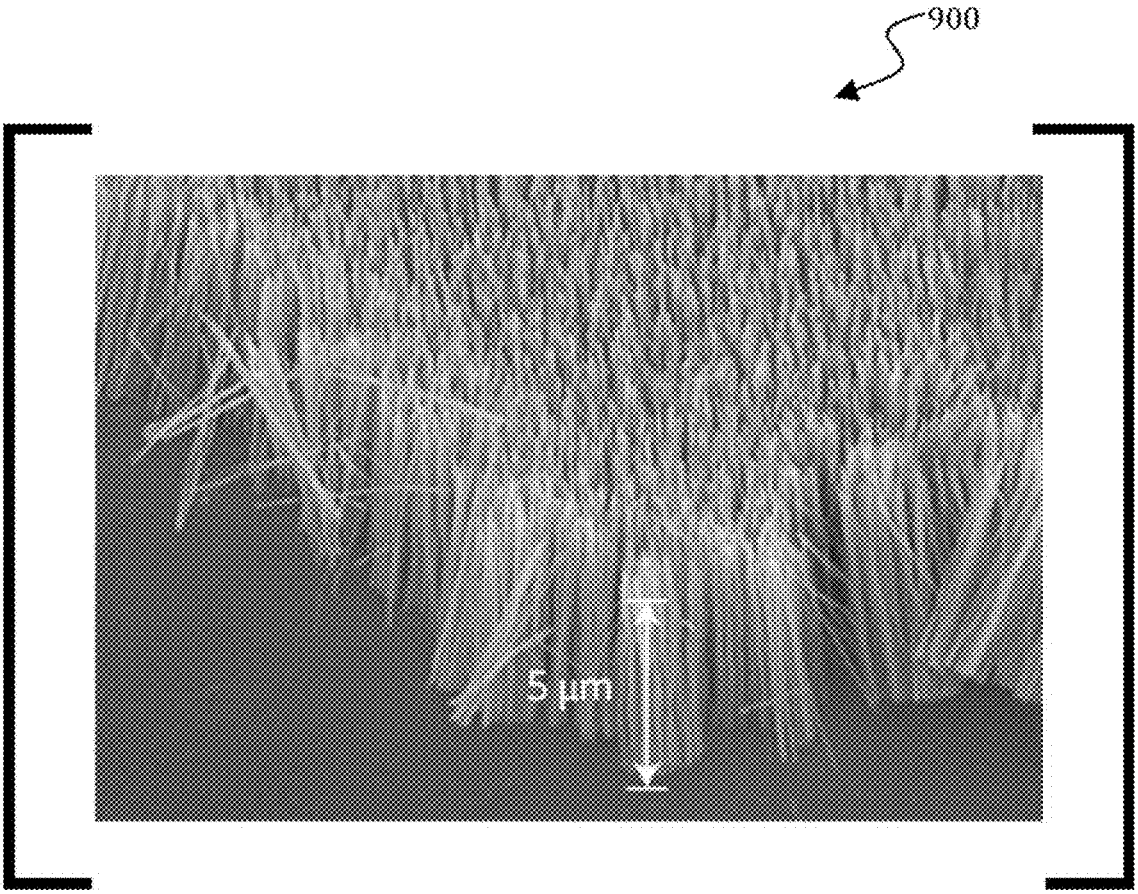
FIG. 9 illustrates an image of a conductive 15 μm long Nickel nanowires.

FIG. 9 illustrates conductive 15 μm long Nickel nanowires 900. The interior of the array is very uniform. Use of this technology can create nanowires of Nb.

Figure 10:
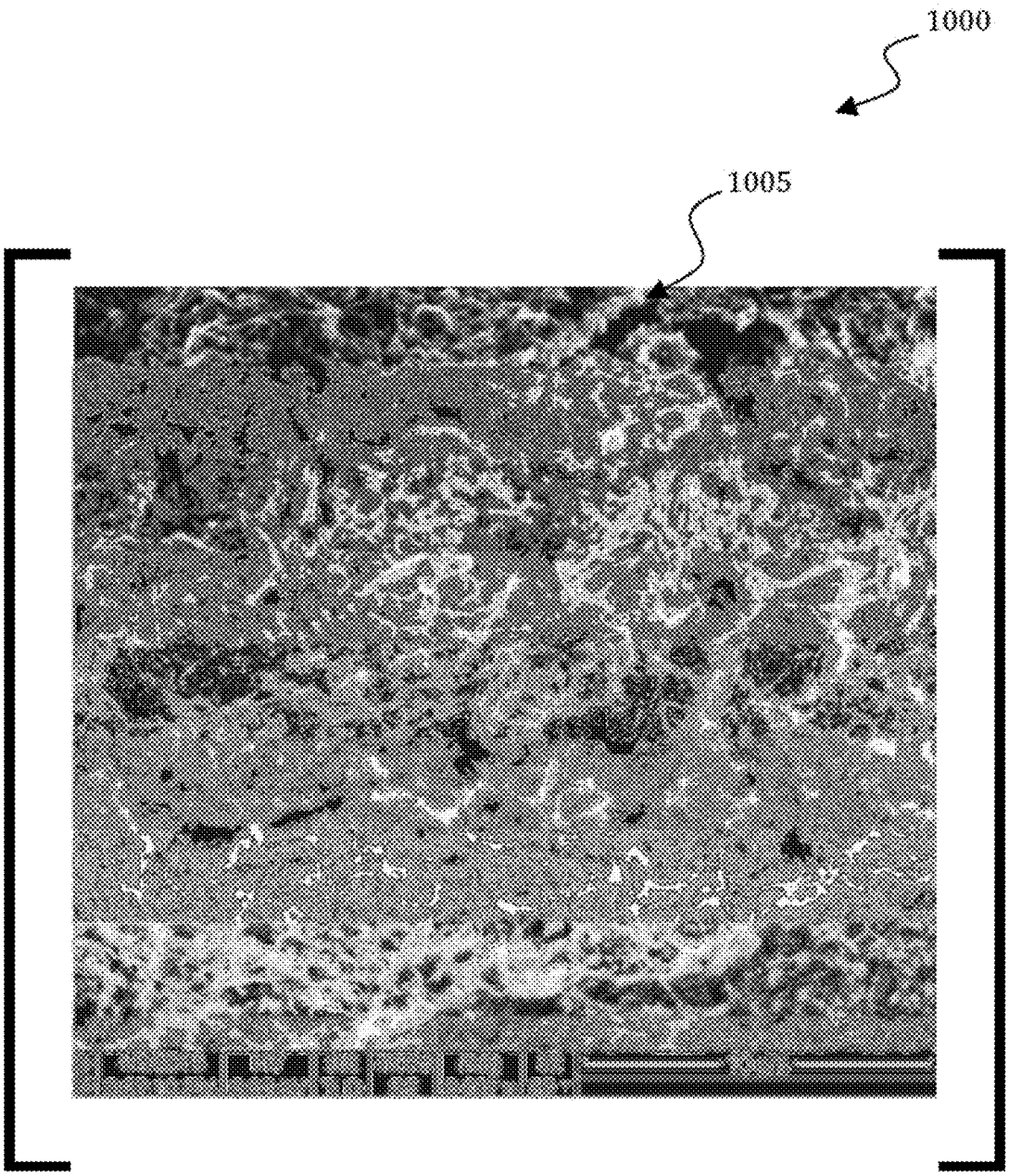
FIG. 10 illustrates a SEM micrograph of carbon nanotubes (CNT) used in an FE cathode.

FIG. 10 illustrates a SEM micrograph 1000 of carbon nanotubes (CNT) 1005 used in a FE cathode.

Figure 11:
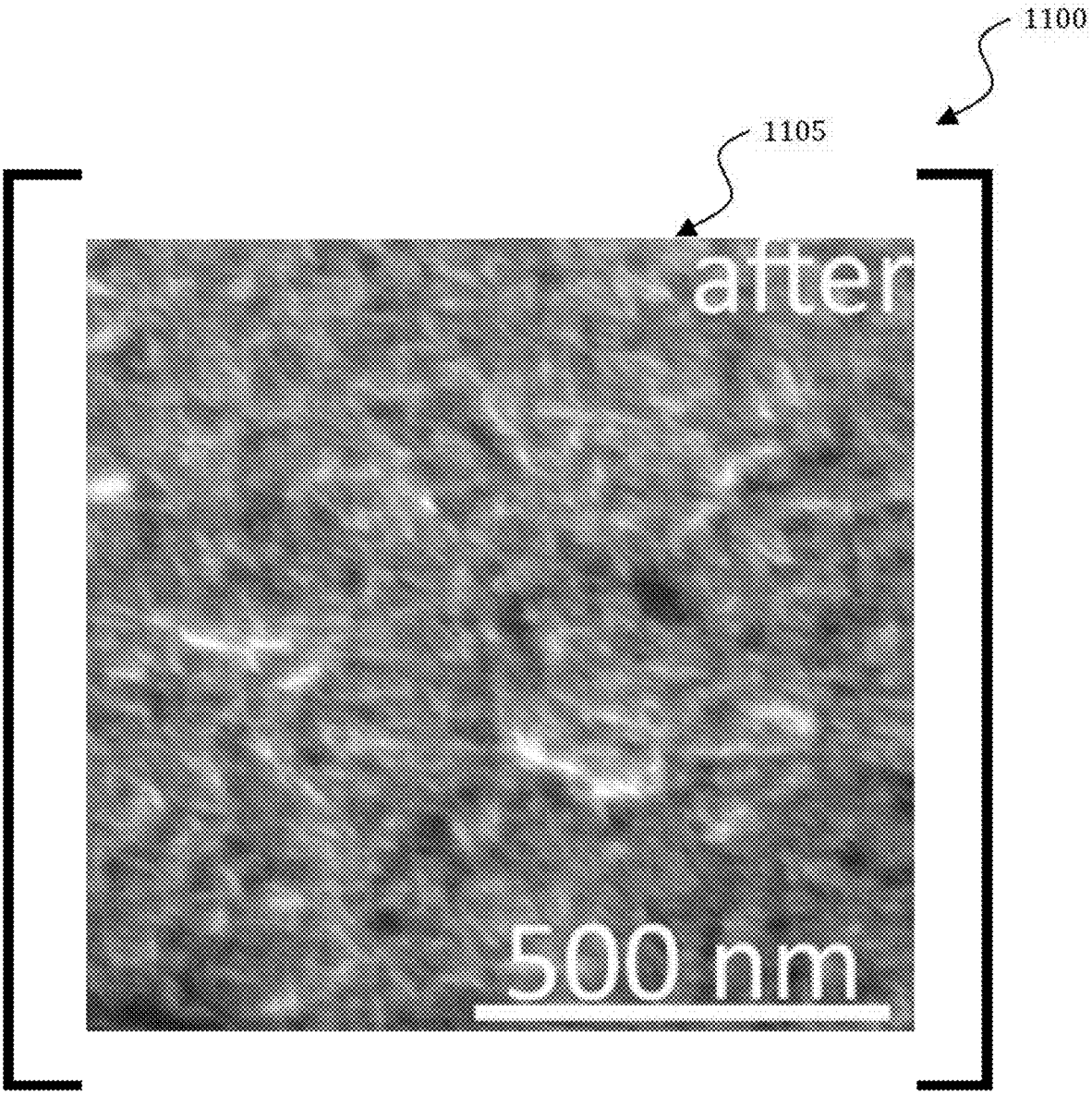
FIG. 11 illustrates SEM images, typical for nitrogen-incorporated ultra-nano-crystalline diamond, (N)UNCD films, on Mo/SS after high power testing.

FIG. 11 illustrates SEM images 1100, typical for nitrogen-incorporated ultra-nano-crystalline diamond, (N)UNCD films 1105, on Mo/SS after high power testing.

Figure 12:
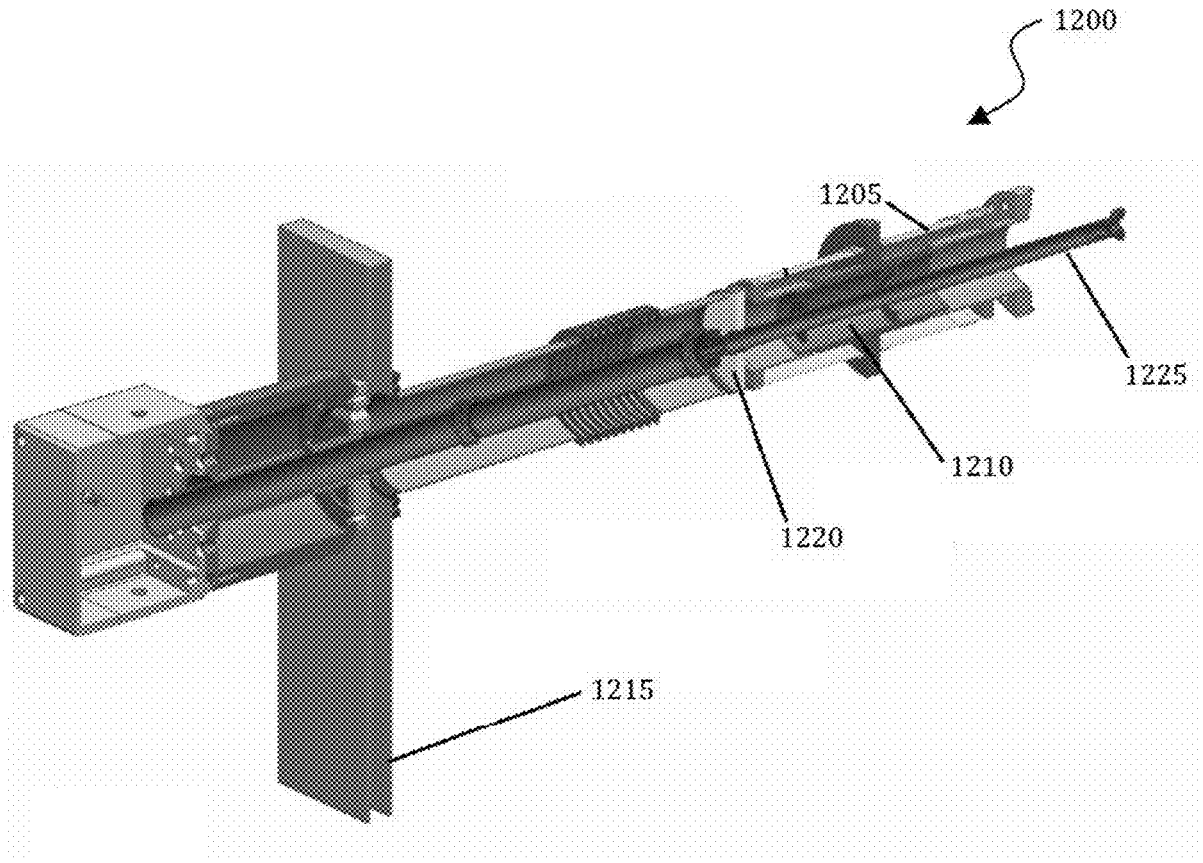
FIGS. 12 and 13 illustrate cut and schematic views, respectively, of a low heat leak fundamental power coupler.
Figure 13:
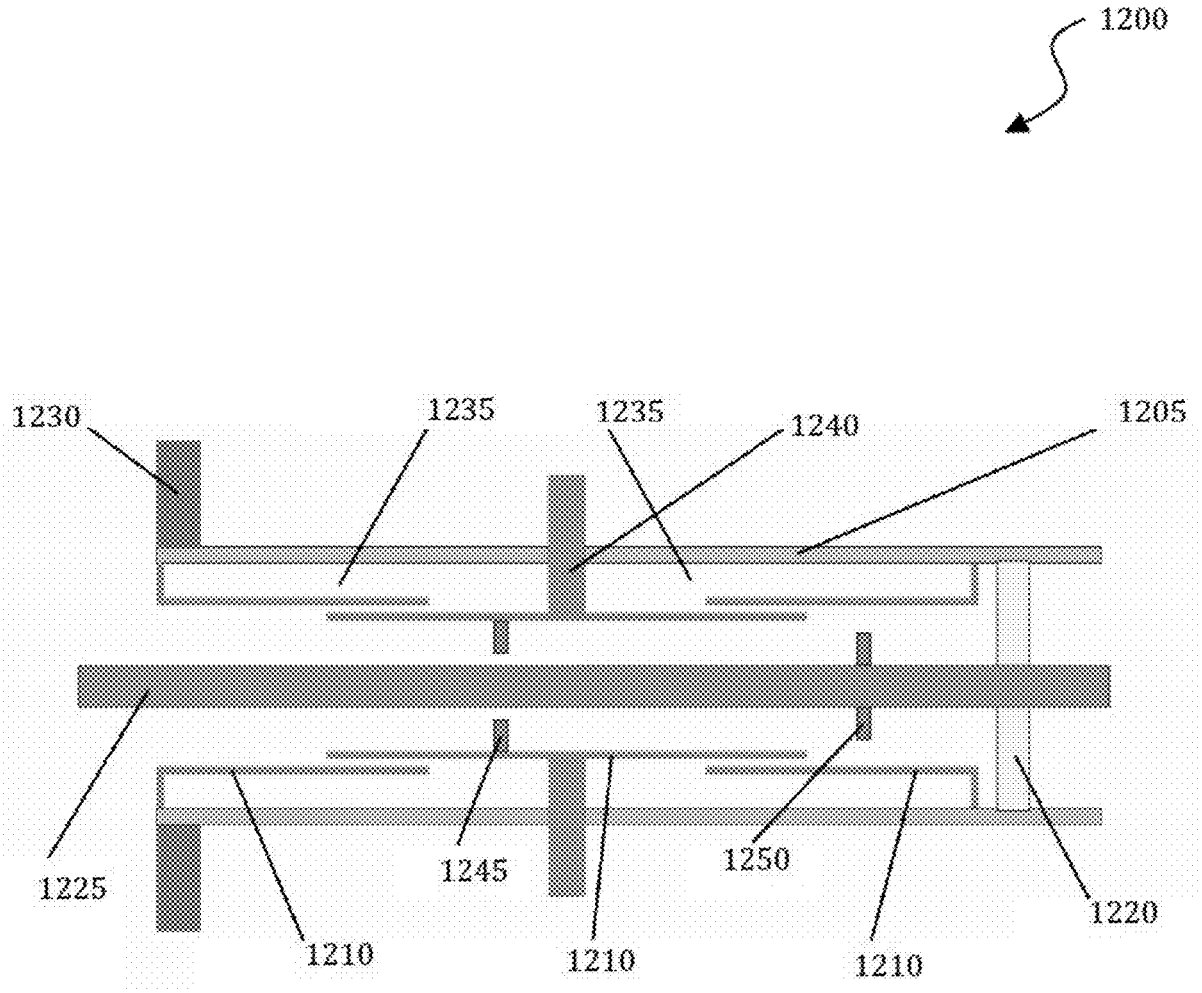

FIGS. 12 and 13 illustrate cut and schematic views, respectively, of low heat leak fundamental power coupler 1200 which couple a cavity to an input waveguide 1215. The coupler's 1200 function is to deliver RF power along an antenna 1225 from the outside RF power source with minimal ohmic losses to the superconducting cavity. A flange 1230 provides a connection to the cavity. The coupler 1200 isolates the cavity vacuum with a ceramic window 1220 and must minimize heat flow from the surroundings at room temperature to the cryogenic temperature cavity. In an embodiment, the outer conductor 1205 is made of stainless steel coated with a thin layer of copper. Heating into the cryogenic system results from ohmic heating in this outer conductor and heat flow from surroundings, thermally conducted to the cavity. The copper coatings are often problematic due to poor adhesion of copper to stainless steel, flaking, and contamination the cavity.

In certain embodiments, solid copper shields 1210 instead of plated copper arranged to produce very low electromagnetic losses in a low thermal conductivity uncoated outer stainless steel tube 1205. Since the copper shields 1210 are made of solid copper, the RRR is very high and ohmic losses are smaller than plated copper. Solid copper also eliminates flaking. Slots prevent heat flow through these copper shields into the cavity. The only unbroken path from cavity to room temperature is via low thermal conductivity stainless steel tube. The combination with appropriate radiation baffles results in very small dynamic and static losses to 4 K.

The coupler uses solid copper shields 1210 instead of plated copper on the outer conductor. This eliminates any possibilities of copper flakes dropping off the outer conductor. The coupler forms two chambers 1235 with very low electromagnetic fields, making the losses in even uncoated stainless steel negligible. The main part of the RF current flows on copper shields 1210. Since the copper shields 1210 are made of solid copper, the RRR is very high and ohmic losses are smaller than in case of plated copper.

There are slots between shields 1210. These slots prevent heat flow through the copper shields 1210. All of the heat flow travels through the outer conductor 1205, which is a low thermal conductivity stainless steel tube in this embodiment. This provides better thermal isolation of the coupler from the room temperature environment.

The shields at least partially overlap. In the embodiment shown, the three shields 1210 have a substantially cylindrical configuration. In the embodiment shown, one shield connects to first a first end of the outer conductor and another shield connects to the second end of the outer conductor, while shield 2 attaches midway between the first and second ends of the outer conductor to thermal intercept 1240.

The spatial configuration of the shields significantly reduces the electromagnetic fields found at the surface of the outer conductor 1205. At the same time, the shields 1210 do not increase the thermal conductivity of the outer conductor 1205 and do not have thermal or mechanical contact between each other. As a result, the coupler utilizes the thermal conductivity of the outer conductor and the electrical conductivity of the shield material. This allows the coupler to have a low thermal conductivity and high electrical conductivity.

The coupler 1200 includes disk 1245 and disk 1250 that surround the RF antenna 1225. Disk 1 at least partially overlaps disk 2, eliminating line of sight between the output coupler and the ceramic surface of the dielectric RF window 1220. Disk 1245 and disk 1250 hide the dielectric surface of the dielectric RF window 1220 from charged particles that can come from the superconducting cavity. Furthermore, disk 1245 has a low temperature, approximately that of liquid nitrogen. This significantly decreases thermal radiation from the room temperature dielectric RF window towards the superconducting cavity.

Because these disks collected charged particles (electrons) without accumulating a charge, the disks must be made of metal. Moreover, to reduce ohmic losses and improve the parameters of the coupler, this metal should have a good electrical conductivity. One embodiment uses copper for these disks.

Certain embodiments of the coupler utilize both the shields and the disks, while others use only the disks or only the shields.

To operate successfully with a 5 W cryocooler, the accelerator 100 shown in FIG. 1 must reside in a cryostat designed to achieve a low static heat leak. In some embodiments, small superconducting magnets cooled by cryocoolers provide beam steering or focusing with <0.5 W static heat leak at 4 K. To establish and maintain the required high cavity $Q_0$, the cavity either be must be carefully magnetically shielded or employ controlled cool down techniques to expel ambient magnetic fields. The cavity must also employ surface processing techniques that prevent unwanted field emission. For CW operation, an injection locked magnetron RF system that dynamically locks to the cavity resonant frequency eliminates the need for either a slow or fast tuner. Controlling and minimizing beam lost to cold surfaces is crucial.

In certain embodiments, the use of high frequency (1.3 GHz) SRF cavities with very low cryogenic losses permits the accelerator to be more compact, cheaper, and achieve better performance including continuous wave operation compared to copper-pulsed linacs or lower frequency SRF accelerators based on spoke resonators. Very low cryogenic losses permit the elimination of cryogens from the accelerator drastically simplifying the system and reducing size and weight enabling mobile applications. At the expense of higher weight and cost, higher power versions of such an accelerator can employ 650 MHz elliptical cavities with twice the beam aperture and even smaller cryogenic losses.

Further, innovations enabling this approach are the use of a compact nanostructure field emission electron sources and a novel, efficient, low cost RF power system based on injection locked magnetron control technology. RF power sources for accelerators have been based on a variety of technologies including triodes, tetrodes, klystrons, IOTs, and solid-state amplifiers. The first four are vacuum tube amplifiers; a technology that has been the prime source for powers exceeding hundreds or even thousands of watts. Solid-state has become a strong competitor to power amplifiers in the kilowatt(s) power level up to 1 GHz. All of these technologies could be employed in various embodiments of a compact SRF accelerator, but they have a significant cost that can range from $5-$25 per watt of output power. These same technologies have AC to RF power efficiency potential of close to 60% in CW saturated operation. These technologies, while functional, are expensive and are relatively inefficient.

Magnetrons are another vacuum tube technology. Unlike the other devices listed, the magnetron is an oscillator, not an amplifier, but it can be injection locked with a driving signal that is a fraction of the output power. The resulting injection "gain" can be on the order of 15-25 dB. This gain level is commensurate with IOTs, triodes, and tetrodes. Klystrons and solid-state can easily achieve gains in excess of 50 dB. The attractive parameter of magnetrons is the cost per watt of output power. Magnetrons are the devices used in kitchen microwave ovens, industrial heating systems, and military radar applications. The cost of a garden variety 1 kW magnetron one might find in their kitchen is under $10. There are simple, ready to use ovens available at under $100 at this power level. Industrial 80 kW continuous wave (CW) heating magnetron sources at 915 MHz are commercially available for $75K.

A benefit of magnetrons is their efficiency. While alternative technologies approach 60% efficiency at saturated power output, industrial magnetrons routinely operate at the 70% to 80% efficiency level. This improved efficiency will considerably reduce the operating electricity cost over the life of an accelerator.

For particle accelerator applications, a high degree of vector control is essential to achieve the required stable accelerating gradient. In the present embodiments, a magnetron can have an output that is essentially a saturated value for the given voltage and current applied to the device. Injection locking can be used to provide a very stable output phase. High dynamic range control of the amplitude is achieved with additional signal conditioning as disclosed herein.

Thus, by filtering all but the carrier signal on the output spectrum of the magnetron, a fully vector controlled power source can be had at a fraction of the cost of alternative methods. This invention becomes specifically attractive for use with SRF cavities in accelerator applications. Tens of megavolts per meter of accelerating gradients can be attained with a modest RF drive power. The cavity acts as a transformer between the RF power amplifier and the accelerating gap seen by the beam. With loaded Q's ranging from 106 to 109, the cavity bandwidth is very narrow, often in the 10s of Hertz. This narrow bandwidth still allows power to accurately control the cavity field and transfer energy to the charged particle beam in a very efficient manor, as there is only a tiny amount of energy dissipated by the superconducting cavity. Because of the narrow bandwidth of the cavity, the PM sidebands, which may start at 300 kHz, are greatly attenuated in the cavity and are reflected by the cavity back to the circulator and to an absorptive load.

Because high levels of power may be reflected from an SRF cavity in certain conditions (i.e., no beam), circulators are installed. A circulator is a three-port device that has low insertion loss in the forward direction (port 1 to 2), high isolation in the reverse direction (port 2 to 1), and low reverse insertion loss to port three (port 2 to 3). Hence, all of the reflected power ends up in a well-matched load on the third port.

Any polar modulation scheme may be used as long as the RF power device is able to track the phase-frequency waveform and the absolute phase reference is maintained. In one embodiment of the invention, a sine wave modulation waveform can be generated in discrete time. Other waveforms such as a triangle may also be used but require more bandwidth. Waveforms may also be optimized for minimal bandwidth.

The embodiments can include magnetrons of various frequencies chosen to match the frequency of the SRF cavity including use of industrial magnetrons at 2.45 GHz, the same frequency used in kitchen microwave ovens. In one embodiment, the CW saturated output power can be 1.2 kilowatts. This frequency and power level were chosen based on cost and availability of components, but others may be advantageously used in other embodiments. It is estimated that an accelerator based RF system using magnetrons at the 80 kW level is only $2-$3 per watt, the added cost over commensurate commercial units is due to the need for a cleaner DC power source and regulation electronics. This poses an impressive savings over other microwave generators for accelerator service.

Figure 14:
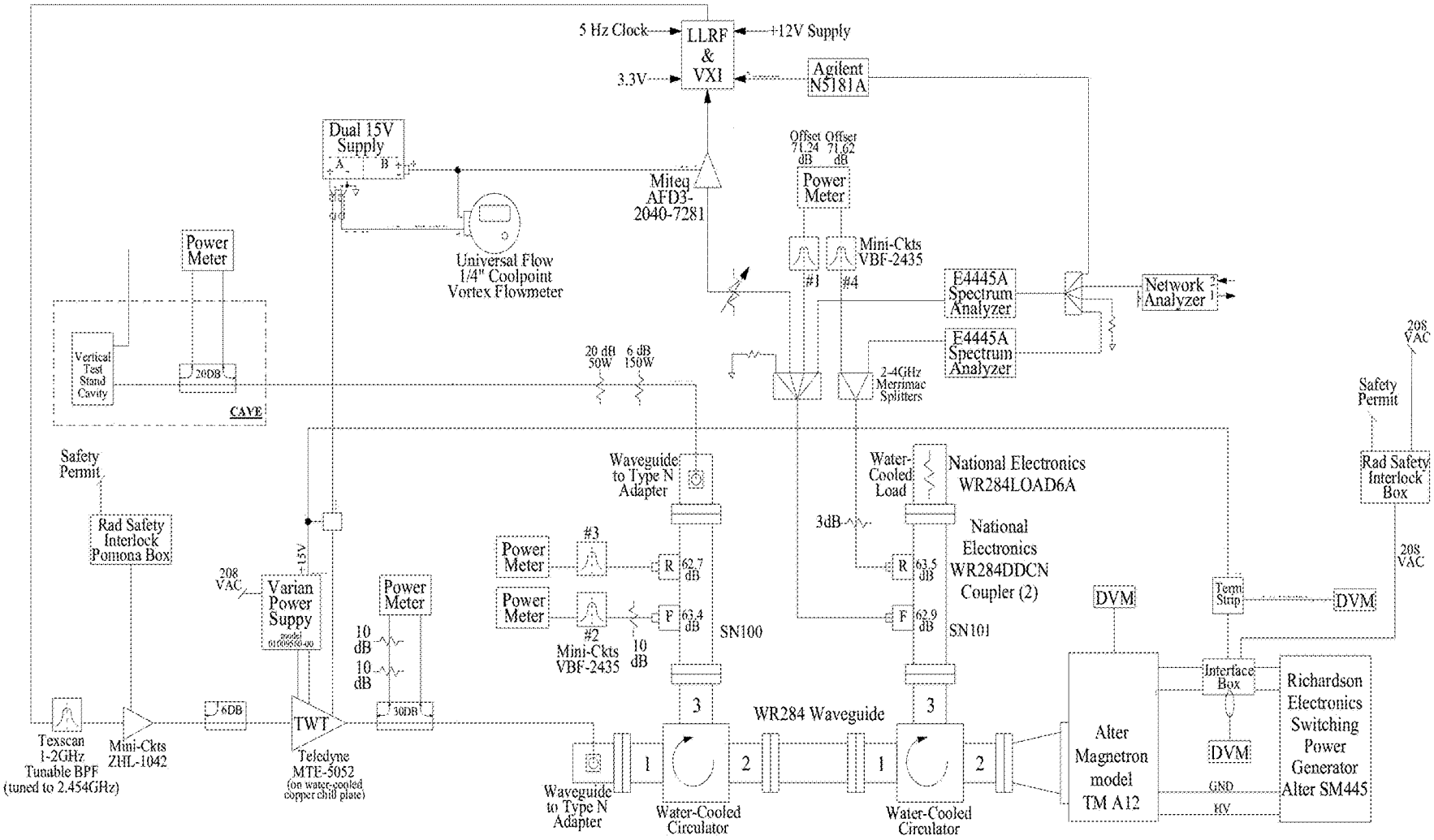
FIGS. 14 and 15 illustrate diagrams of the injection-locked magnetron.
Figure 15:
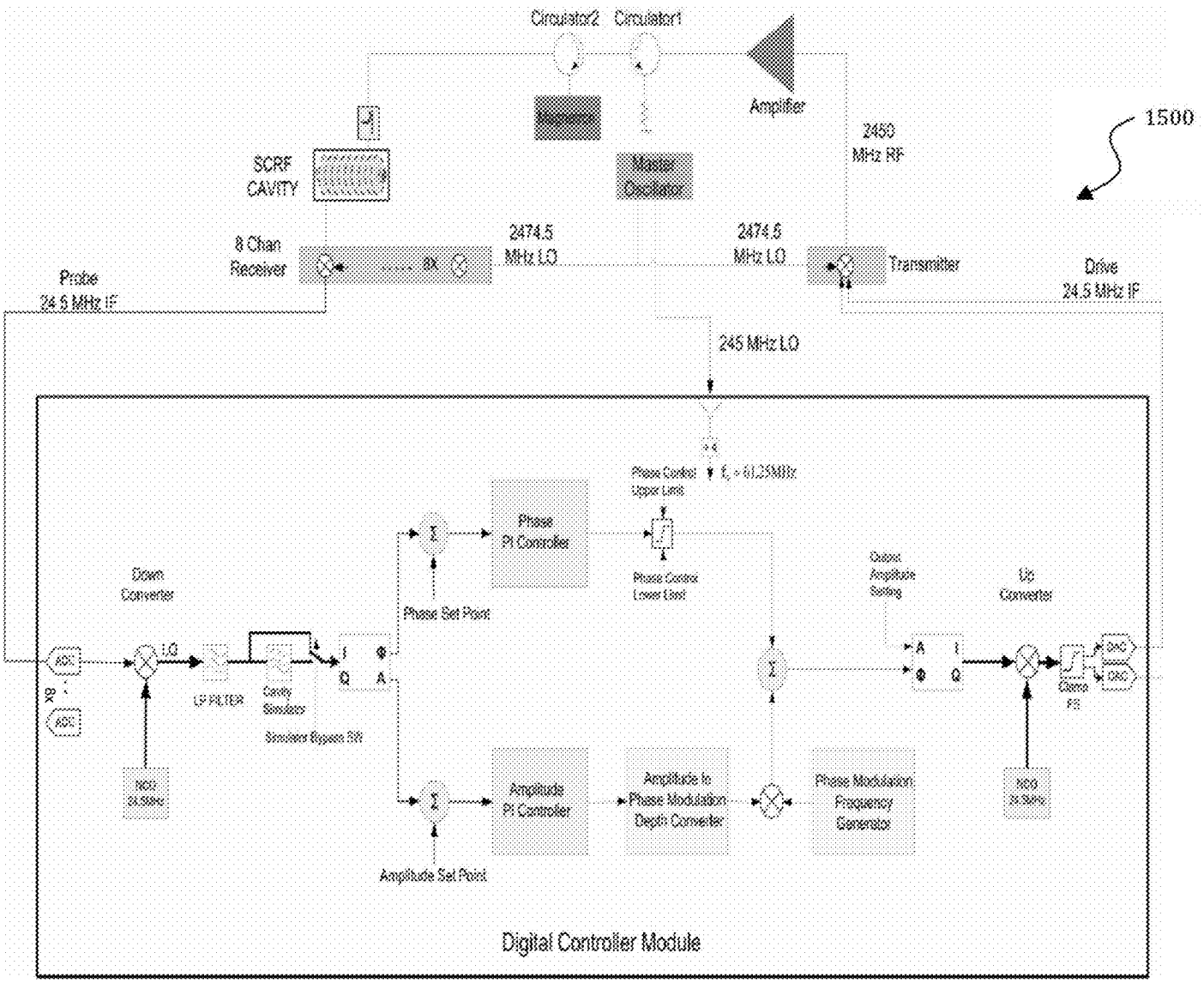

FIGS. 14 and 15 illustrate diagrams of the injection-locked magnetron 1400 and 1500. The magnetron is an oscillator (i.e., a self-generating RF power source). A magnetron can be forced to operate at a very specific frequency within its oscillation range by injection locking. Injection locking is an effect that occurs when a harmonic oscillator is disturbed by a second oscillator operating at a similar frequency. When the coupling between the oscillators is sufficient and when the frequencies are similar, the first oscillator will have essentially an identical frequency as the second. In this embodiment, the magnetron has an "injection gain" of the input-driving signal that can range from 15 to 25 dB, the highest gain coming from the lowest drive signal that will cleanly lock the oscillation frequency of the magnetron.

Injection locking requires a significant number of components in addition to the magnetron and its power supply. As shown in FIG. 15, two circulators act as isolation devices, a drive amplifier, directional couplers for signal monitoring, and interlock and protection circuitry are all used as part of the injection locking mechanism 1500. The embodiment illustrated in FIG. 14 uses an industrial 2.45 GHz magnetron capable of 1.2 kilowatts of continuous output power (CW). It should be appreciated that other magnetrons may be used according to design considerations, and the magnetron described herein is not intended to limit the scope of the invention. In this embodiment, injection gain for locking is on the order of 20 dB or a factor of 100. In this embodiment, a drive power of only 12 watts is required.

A traveling wave tube (TWT) amplifier is illustrated in FIG. 14. In other embodiments, any amplifier could be used. In a preferred embodiment, this could be a solid-state unit or in a very high power system greater than 100 kW, such as another injection locked magnetron. The TWT drive is coupled to the first of two series circulators. The circulator illustrated is a three-port device that has low insertion loss in the forward direction (port 1 to 2), high isolation in the reverse direction (port 2 to 1), and low reverse insertion loss to port three (port 2 to 3). The throughput power is then applied to the second circulator with minimal insertion loss and passed on to the magnetron input. The magnetron is a one-port device, so the input power and output power are on the same spigot. For an RF power system like that shown in FIG. 14, the power out of the magnetron is then passed to port 3 of the circulator 2 and on to the load.

No loads are perfect and some power will be reflected to circulator 2. In the case of a superconducting RF (SRF) cavity, all the RF power is reflected until the particle beam transverses the cavity gap. This reflected power must not reach the drive amplifier as it could easily destroy it. Here, circulator 1 guides the reflected power safely to a load on port 3. Typical isolation factors for circulators exceed 100.

In the embodiment shown in FIG. 14, with an actual SRF cavity, the power needed in absence of a beam is very small. Thus, one may choose to terminate port 3 of circulator 2 with a load and use only a small portion of the output power from the magnetron that is reflected by the load on circulator 2 to drive the SRF cavity via circulator 1 port 3.

The low level RF (LLRF) generates the drive signal and a sample of the cavity voltage can be fed back to the LLRF for closed loop regulation of amplitude and phase. Power levels are measured at all the test ports where directional couplers are located. For safe operation, it is important to monitor water flow and x-ray detectors near the cavity. These are incorporated into the interlock system.

A block diagram of the LLRF system 1500 is shown in FIG. 15. A signal path may be traced through various sections of the embodiments shown herein. First, a superheterodyne 8-channel microwave receiver down-converts the 2.45 GHz cavity probe signal to a 24.5 MHz intermediate frequency (IF). This is followed by an analog to digital converter and digital receiver that converts the IF to a baseband analytic signal within a Field Programmable Gate Array (FPGA). The complex In-phase and Quadrature signals (1/Q) can be sent through, or bypass, the cavity simulator before being converted to amplitude and phase by a CORDIC block.

These amplitude and phase signals are then input to the respective error summing junctions of two proportional-integral (PI) feedback controllers. The amplitude controller output drives a PM to AM linearizing block, creating a phase modulation depth control signal that is multiplied with a sine wave of a programmed frequency. This now amplitude controlled sine wave is summed with phase shift request of the phase control providing the phase modulation input to the second CORDIC block. The amplitude input of the CORDIC is a settable parameter that is held constant during operation. The amplitude PI controller controls the phase modulation depth of the signal of a sinusoidal phase modulator of fixed frequency. Modulation frequencies range from 100 kHz to 500 kHz. A lookup table linearizes the relationship between amplitude request and modulation depth request. The in-phase and quadrature term outputs of the CORDIC are digitally up-converted back to the IF frequency before being converted back to analog and then up-converted from IF back to RF. The output drive is then a constant amplitude carrier that is phase modulated by the sum of the phase controller and the sinusoidal phase modulator.

This LLRF drive signal is amplified and then injected into the magnetron, which frequency and phase locks to the drive. The magnetron output signal is directed by the circulator to the cavity and contains all the PM generated sidebands generated by the LLRF system. The center frequency signal now contains only the intended amplitude signal as requested by the AM PI controller and the phase information requested by the PM PI controller. The PM sidebands are spaced out in multiples of the phase modulator frequency and are rejected by the narrow band cavity back to the circulator and are terminated by the load. The cavity probe signal is returned to the LLRF system and is used as the feedback path signal.

Phase modulation is used to control the amplitude of the carrier and can be approached using either time or frequency domain analysis.

A sinusoidal phase modulated signal is expressed as equation (1):

$$y(t)=A_c \sin(\omega_c t+A_m \sin(\omega_m t)+\phi_c \quad (1)$$

with the phase modulation term: Am sin(wm t), where Am is the modulation depth and (J)m is the modulation frequency. Frequency translation to baseband (we=0) allows for simple phasor analysis and because the cavity bandwidth may be 10,000 times smaller than the modulation frequency, the modulation sidebands become insignificant and only the carrier phasor is left. Integrating and removing small terms leaves equation (2):

$$y_{(carrier)}=A_c \cos(A_m)+\phi_c \quad (2)$$

Figure 16:
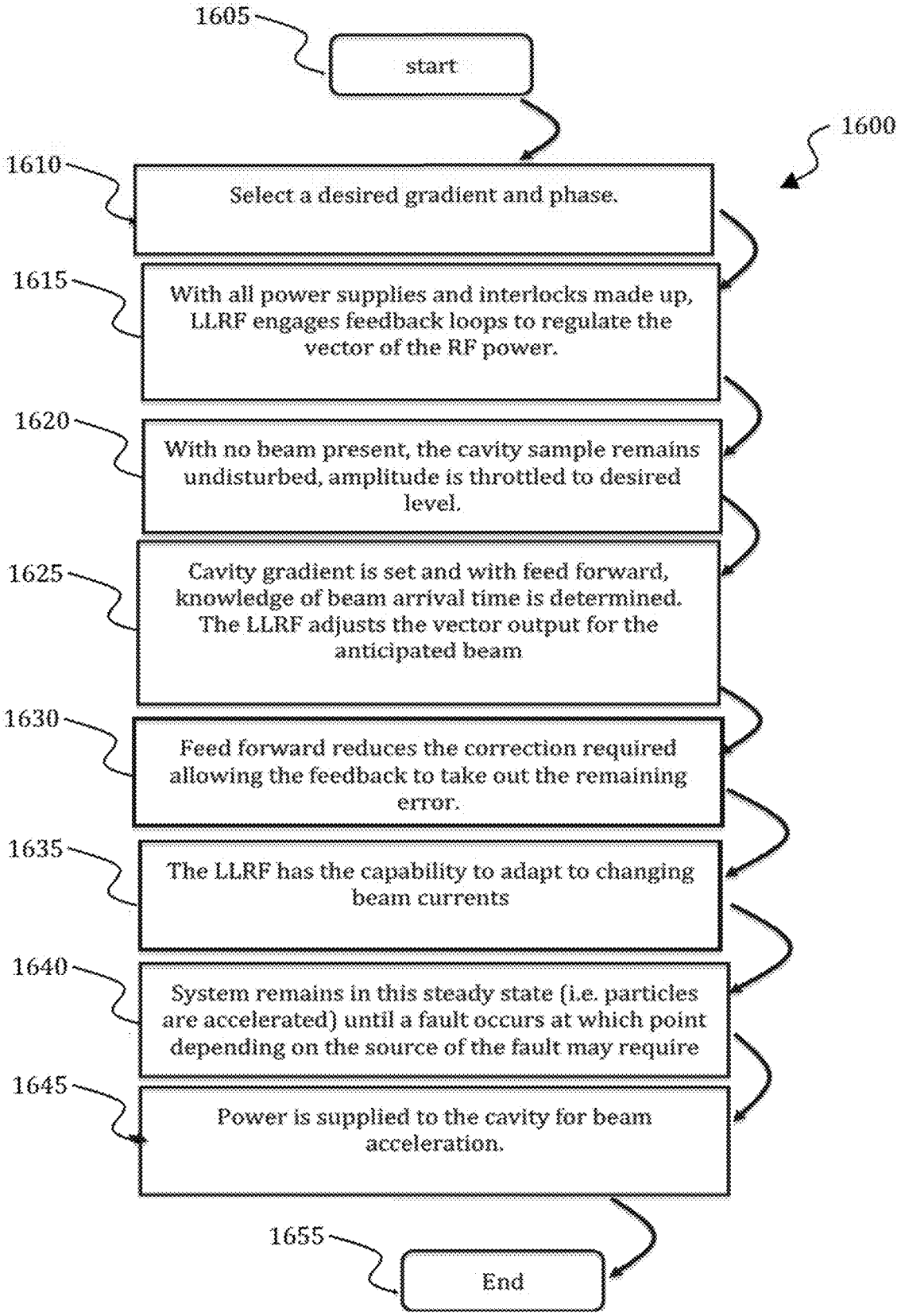
FIG. 16 illustrates method steps associated with the operation of the injection-locked magnetron.

FIG. 16 illustrates method steps 1600 associated with the operation of the injection-locked magnetron systems and apparatus disclosed herein. The method begins at step 1605. At step 1610, a desired gradient and phase are selected. At step 1615, power supplies and interlocks are made up in advance so that an LLRF can engage feedback loops to regulate the vector of RF power. In a preferred embodiment, the RF power is being supplied to a particle accelerator. At step 1620, no beam is yet present in the accelerator. The cavity sample is undisturbed and the amplitude is throttled up to a desired level to achieve the desired acceleration gradient. This level may be predetermined.

Next at step 1625, the cavity gradient is set and with feed forward and the beam arrival time is determined. The LLRF can adjust the vector output for the anticipated beam in this step. Feed forward reduces the correction required by allowing the feedback to eliminate any remaining error at step 1630. The LLRF dynamically adjusts to changing beam currents as shown at step 1635.

From this point the system can remain in a steady state, i.e., providing acceleration of the particles in the accelerator. This mode continues undisturbed unless and until a fault occurs at step 1640. Depending on the nature of the fault, operator intervention may be required. The power is then supplied to the cavity for beam acceleration at step 1645. The method then ends at step 1655.

With dynamic heating of less than 5 W for a high $Q_0$ nine-cell 1300 MHz SRF cavity, conduction cooling of the SRF cavity is possible in certain embodiments. This is a significant departure from traditional implementations which required locating the cavity inside a liquid Helium filled pressure vessel. The temperature increase from the cryocooler cold tip to the cavity 100 in FIG. 1 can be less than or approximately 0.5 K. Conduction cooling results in further simplification of the SRF accelerator cryomodule. It is important to realize that the accelerator cryomodule illustrated in FIG. 1 contains no liquid Helium pressure vessels, piping, or inventory resulting in both large cost savings and dramatic simplifications in the required safety analysis. If the electron source is also made compact and integrated into the cavity additional reductions in size, weight, and cost are realized.

Figure 17:
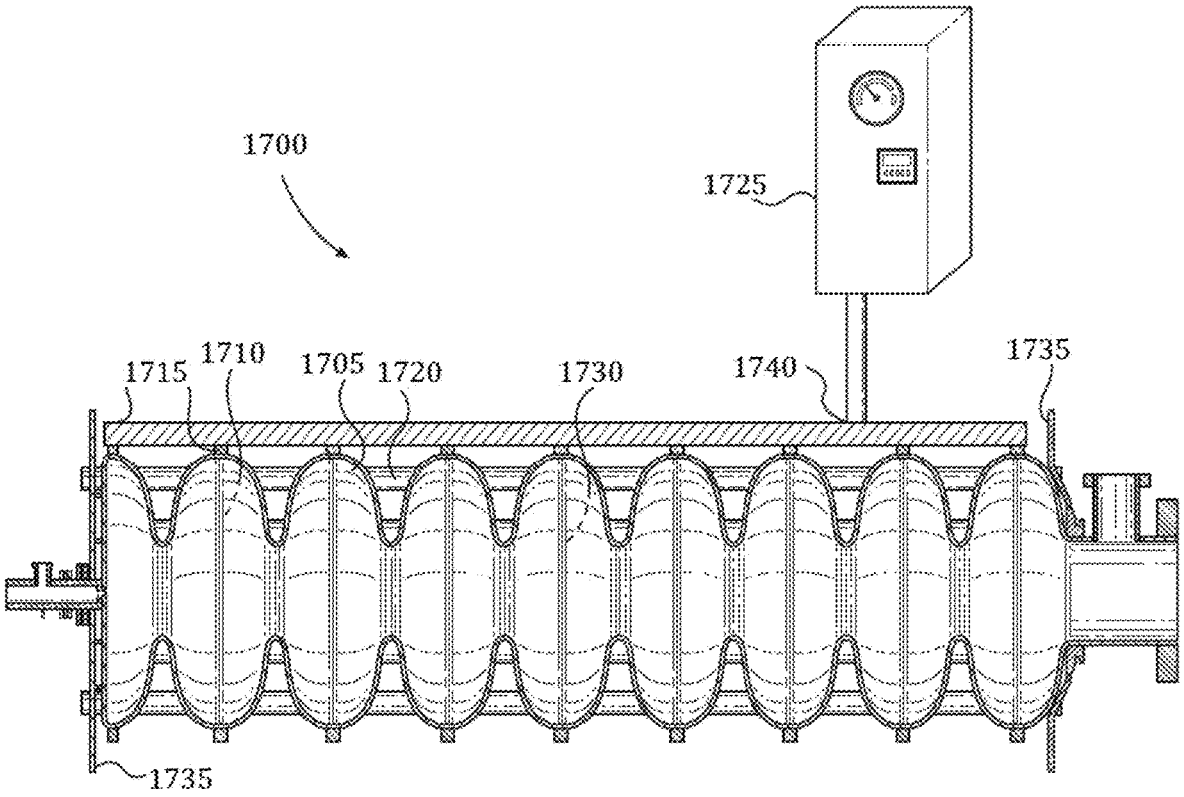
FIG. 17 illustrates an exemplary embodiment of a system for conduction cooling linear accelerator cavities.

FIG. 17 illustrates an exemplary embodiment of a system 1700 for conduction cooling linear accelerator cavities. System 1700 includes at least one linear accelerator cavity 1705, at least one cavity cooler 1710, a cooling connector 1715, an optional mechanical support system 1720, and a refrigeration source 1725. The average cross-section A of cavity cooler 1710 and cooling connector 1715 is determined using the equation (3):

$$A = \frac{Q * L}{\Delta T * C} \tag{3}$$

wherein Q is an average heat load of linear accelerator cavity 1700, L is an average distance between linear accelerator cavity 1700 and refrigeration source 1725, ΔT is a maximum allowable temperature rise from linear accelerator cavity 1700 to refrigeration source 1725, and C is a thermal conductivity of cavity cooler 1710 and cooling connector 1715.

In the exemplary embodiment, linear accelerator cavity 1700 is an SRF cavity with a minimum quality factor of approximately $1\times10^8$. Linear accelerator cavity 1700 comprises a metallic or ceramic material that is superconducting at a cavity operating temperature. This material may constitute the entire cavity or be a coating on an inner surface of linear accelerator cavity 1700. In the exemplary embodiment, linear accelerator cavity 1700 comprises pure niobium. In other embodiments, linear accelerator cavity 1700 may be, but is not limited to, a niobium, aluminum or copper cavity coated in niobium-tin ($Nb_3Sn$) or other superconducting materials.

In the exemplary embodiment, cavity cooler 1710 at least partially encircles linear accelerator cavity 1700, making thermal contact to remove heat from linear accelerator cavity 1700. Materials used for cavity cooler 1710 must have a minimum thermal conductivity of approximately $1\times10^4$ W $m^{-1}$ $K^{-1}$ at temperatures of approximately 4 degrees K. Such materials with high thermal conductivity include, but are not limited to, high-purity aluminum, diamond, or carbon nanotubes. In certain embodiments, cavity cooler 1710 includes multiple cavity coolers 1710.

Cavity cooler 1710 may also include an intermediate conduction layer 1730 between cavity cooler 1710 and linear accelerator cavity 1700 to lower contact resistance and improve thermal conductivity. Intermediate conduction layer 1730 is a ductile material, such as, but not limited to, indium or lead. The thermal conductivity of intermediate conduction layer 1730 results in a thermal resistance between linear accelerator cavity 1700 and cavity cooler 1710 of no more than approximately 10% of the thermal conductivity of cavity cooler 1710.

In the exemplary embodiment, cooling connector 1715 connects each cavity cooler 1710 to refrigeration source 1725. Materials used for cooling connector 1715 must have a minimum thermal conductivity of approximately $1\times10^4$ W $m^{-1}$ $K^{-1}$ at temperatures of approximately 4 degrees K. Such materials with high thermal conductivity, include, but are not limited to, high-purity aluminum, diamond, or carbon nanotubes. In certain embodiments, multiple cooling connectors 1715 connect cavity cooler 1710 to refrigeration source 1725. In certain embodiments, cooling connectors 1715 are flexible.

Optional mechanical support system 1720 stabilizes linear accelerator cavity 1700. In the exemplary embodiment, mechanical support system 1720 is a plurality of support rods. In another embodiment, mechanical support system 1720 is a solid cylinder. Mechanical support system 1720 connects to linear accelerator cavity 1700 via endplates 1735. Mechanical support system 1720 and endplates 1735 are made of a material having an identical or substantially similar thermal expansion coefficient as linear accelerator cavity 1700.

In the exemplary embodiment, refrigeration source 1725 is a commercially available cryocooler having a power requirement of approximately 1 W to approximately 100 W. In another embodiment, refrigeration source 1725 is a vessel containing cryogenic fluid. A cold tip 1740 of refrigeration source 1725 clamps to cooling connector 1715. The clamping connection results in a thermal resistance between cooling connector 1715 and cold tip 1740 of no more than approximately 10% of the thermal resistance of cooling connector 1715, allowing efficient conduction of heat from cooling connector 1715 to refrigeration source 1725.

Figure 18:
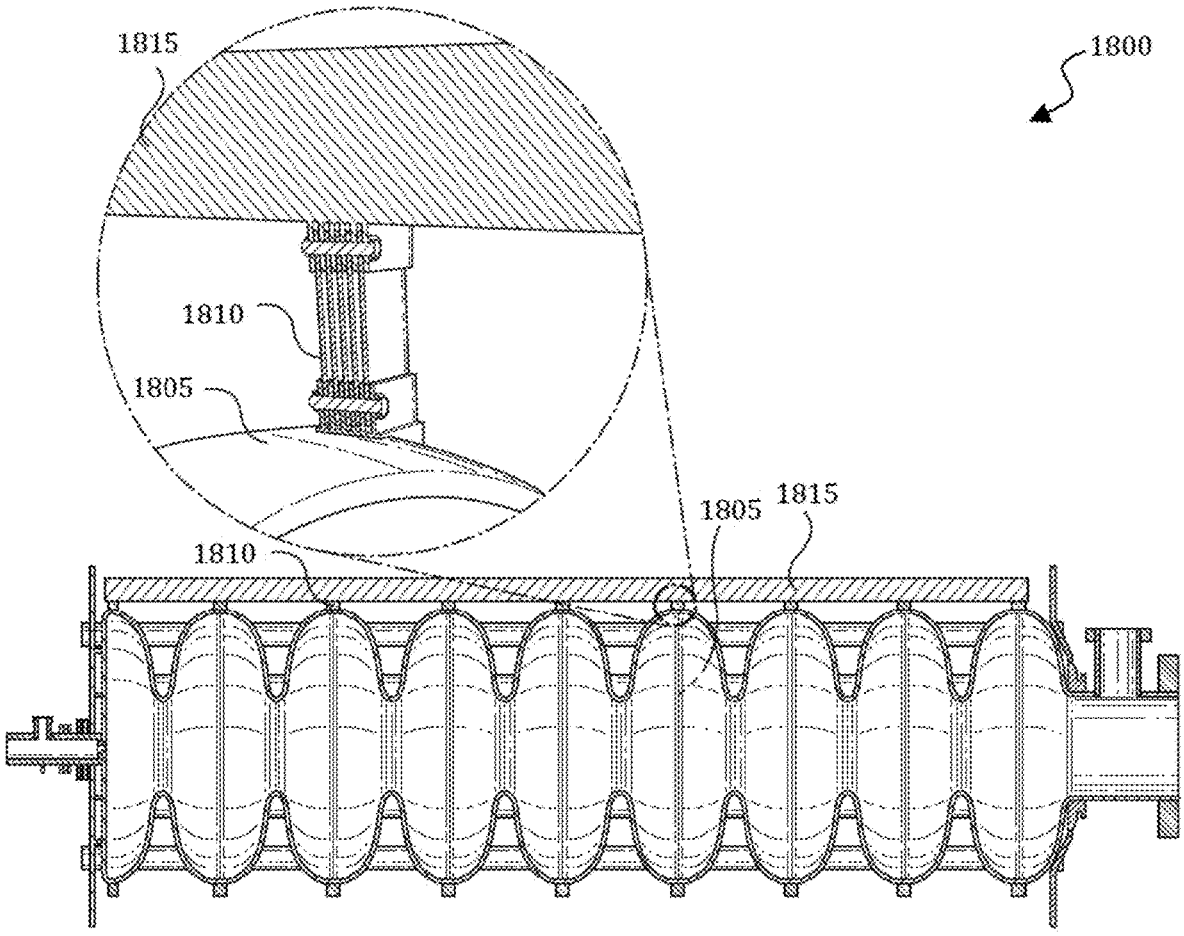
FIGS. 18-20 illustrate alternate embodiments of systems for conduction cooling linear accelerator cavities.

FIG. 18 illustrates an alternate embodiment of a system 1800 for conduction cooling linear accelerator cavities 1700. In system 1800, cavity cooler 1710 is a cooling ring 1805 and cooling connector 1715 is a plurality of cooling strips 1810 connected to a cooling bar 1815. Cooling ring 1805 may be applied to linear accelerator cavity 1700 through direct casting, diffusion bonding, mechanical clamping, stud welding, or any other fabrication method resulting in a low thermal conductivity connection.

Figure 19:
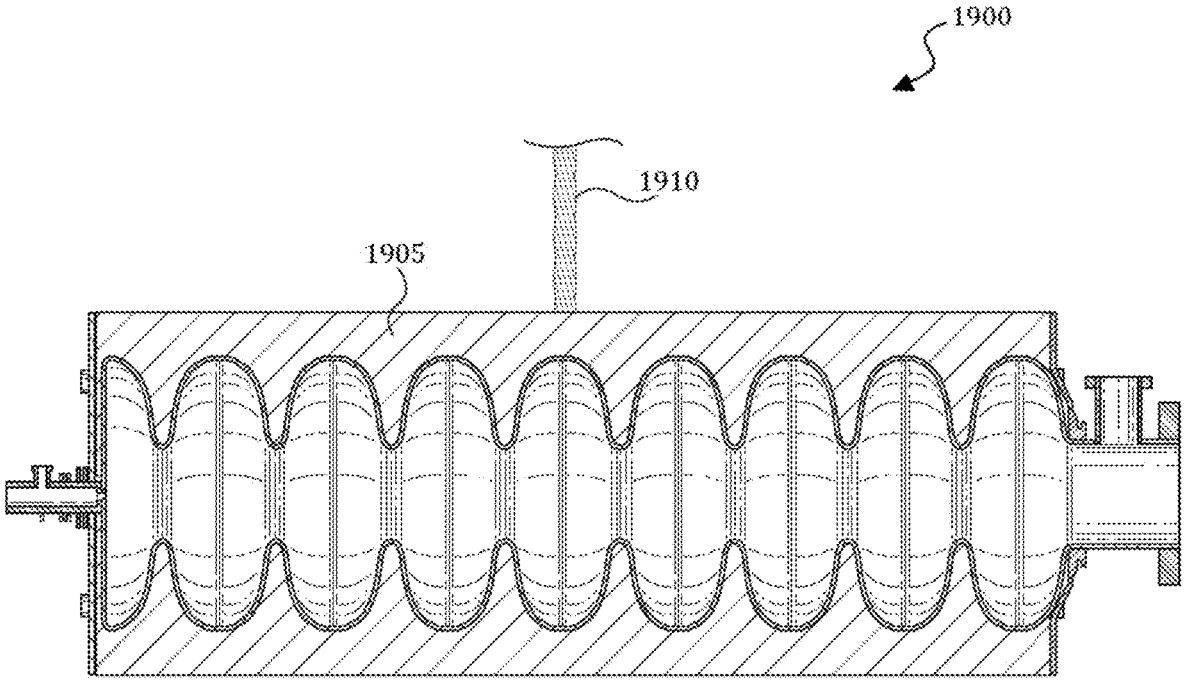

FIG. 19 illustrates an alternate embodiment of a system 1900 for conduction cooling linear accelerator cavities 1700. In the embodiment of system 1900, cavity cooler 1710 forms an integral cooling block 1905 around multiple linear accelerator cavities 1700 and cooling connector 1715 is a flexible cooling braid 1910. In this embodiment, mechanical support system 1720 is unnecessary. Cooling block 1905 may be applied to linear accelerator cavity 1700 through direct casting, mechanical clamping, stud welding, or any other fabrication method resulting in a low thermal conductivity connection.

Figure 20:
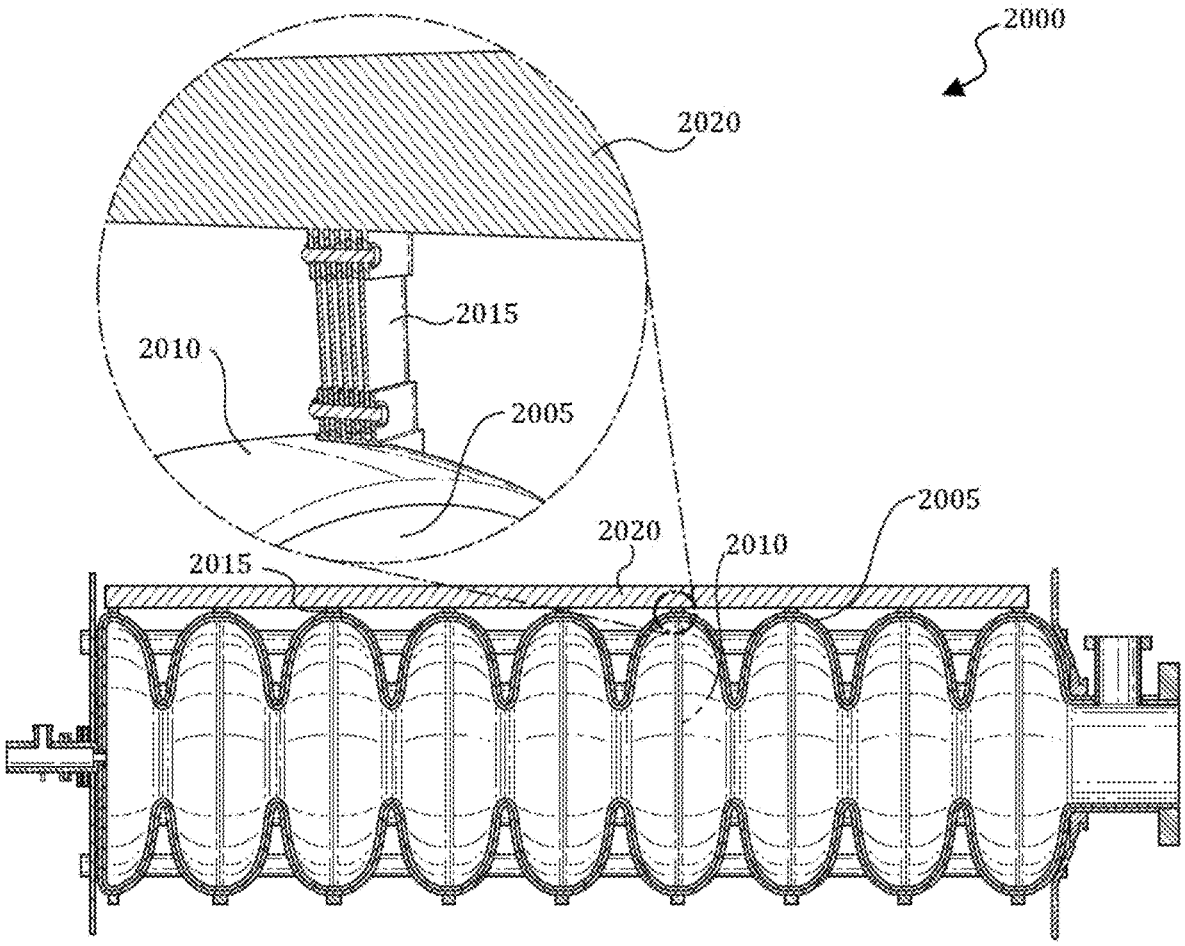

FIG. 20 illustrates an alternate embodiment of a system 2000 for conduction cooling linear accelerator cavities 1700. In the embodiment of system 2000, cavity cooler 1710 is a coating 2005 and a cooling ring 2010 around a portion of linear accelerator cavity 1700, while cooling connector 1715 is a plurality of cooling strips 2015 connected to a cooling cylinder 2020 or individually thermally connected to the cavity surface via stud welding or other mechanical means that achieves good thermal contact. Coating 2005 may be applied to linear accelerator cavity 1700 through direct casting, diffusion bonding, mechanical clamping, stud welding, or any other fabrication method resulting in a low thermal conductivity connection.

Figure 21:
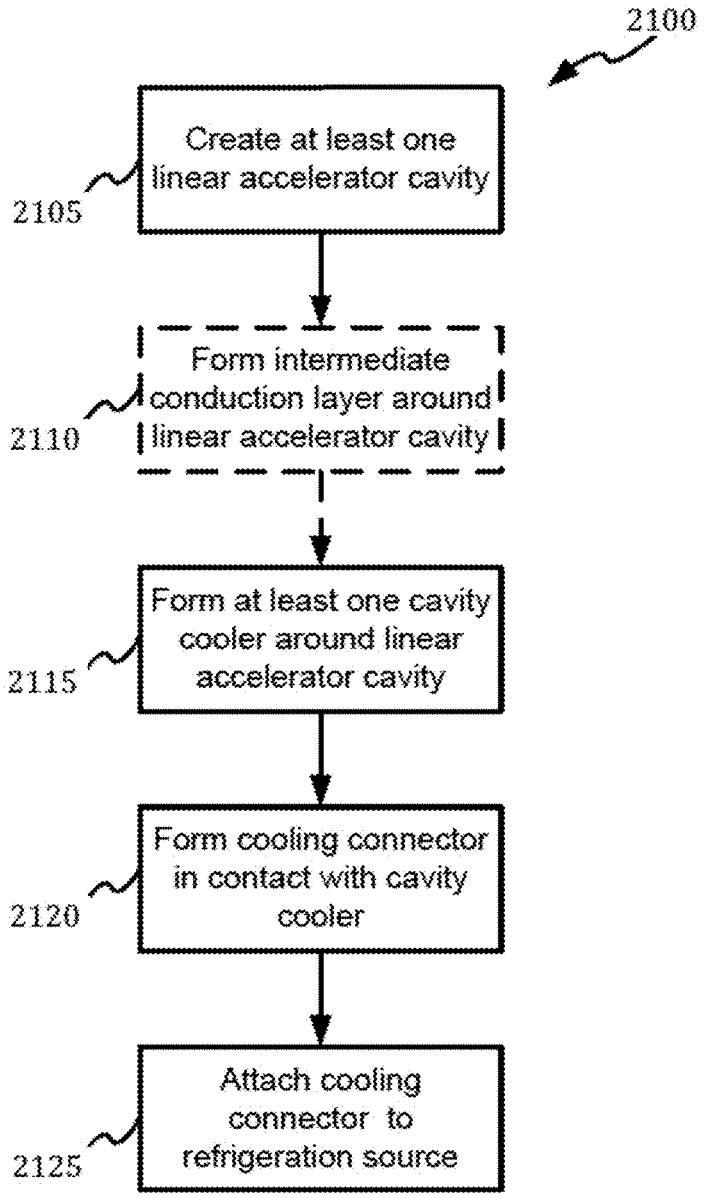
FIG. 21 illustrates a flowchart of an exemplary embodiment of a method of making a system for conduction cooling linear accelerator cavities.

FIG. 21 illustrates a flowchart of an exemplary embodiment of a method 2100 of making a system 100 for conduction cooling linear accelerator cavities 1700.

In step 2105, method 2100 creates at least one linear accelerator cavity 1700.

In optional step 2110, method 2100 forms intermediate conduction layer 1730 around or over at least part of linear accelerator cavity 1700.

In step 2115, method 2100 forms at least one cavity cooler 1710 around or over at least part of linear accelerator cavity 1700. This formation may be through casting, fabrication, stud welding, or deposition.

In step 2120, method 2100 forms at least one cooling connector 1715 in contact with at least one cavity cooler 1710. This formation may be through casting, fabrication, or deposition. In certain embodiments, method 2100 may perform steps 2115 and 2120 simultaneously.

In step 2125, method 2100 attaches cooling connector 1715 to refrigeration source 1725. In one embodiment, cold tip 1740 of refrigeration source 1725 clamps to cooling connector 1710.

Certain embodiments utilize single cavity accelerators at other frequencies. One embodiment uses a cavity for a lower frequency (e.g., 650 MHz) to build higher beam power machines. Another embodiment uses a cavity for a higher frequency to be more compact.

Certain embodiments utilize accelerators using the above configurations, but with multiple cavities to achieve higher energy.

Certain embodiments utilize alternative cavity shapes such as spoke resonators and quarter- and half-wave cavities of various frequencies.

Certain embodiments utilize cavities designed for particles traveling slower than the speed of light (e.g., for protons or ions).

Certain embodiments utilize conduction cooling with a pipe full of liquid cryogen in place of the cryo-cooler to allow cooling of many cavities.

Taken together these innovative technologies enable a new class of compact, simple, SRF based accelerators for industrial, scientific, non-destructive testing, and security applications.

Certain embodiments of the design may include all or some of the above-referenced elements. It will be understood that many additional changes in the details, materials, procedures and arrangement of parts, which have been herein described and illustrated to explain the nature of the invention, may be made by those skilled in the art within the principle and scope of the invention as expressed in the appended claims.

It should be further understood that the drawings are not necessarily to scale; instead, emphasis has been placed upon illustrating the principles of the invention. Moreover, the terms "about," "substantially," or "approximately" as used herein may be applied to modify any quantitative representation that could permissibly vary without resulting in a change in the basic function to which it is related.

Based on the foregoing, it can be appreciated that a number of embodiments, preferred and alternative, are disclosed herein. For example, in one embodiment, an accelerator comprises at least one accelerator cavity an electron gun, at least one cavity cooler configured to at least partially encircle the accelerator cavity, a cooling connector, and a refrigeration source for providing refrigerant via the cooling connector to the at least one cavity cooler.

In an embodiment, the accelerator further comprises an intermediate conduction layer formed between the at least one cavity cooler and the at least one accelerator cavity configured to facilitate thermal conductivity between the cavity cooler and the accelerator cavity. In an embodiment, the intermediate conduction layer is configured of a ductile material comprising one of indium and lead.

In an embodiment, the cooling connector has a minimum thermal conductivity of $1\times10^4$ W $m^{-1}$ $K^{-1}$ at temperatures of 4 degrees K.

In another embodiment, a mechanical support is connected to the accelerator cavity via at least one endplate and configured for stabilizing the accelerator cavity. In an embodiment, the mechanical support comprises at least one of a plurality of support rods and a solid cylinder.

In another embodiment, the refrigeration source further comprises a vessel containing a cryogenic fluid. In an embodiment, the accelerator further comprises a cold tip associated with the refrigeration source clamped to the cooling connector wherein the clamp provides a thermal conductor between the refrigeration source and the cooling connector. A thermal resistance between the cooling connector and cold tip is no more than 10% of a thermal resistance of the cooling connector thereby providing efficient conduction of heat from the cooling connector to the refrigeration source.

In another embodiment, a system comprises at least one accelerator cavity, an electron gun, at least one cavity cooler configured to at least partially encircle the accelerator cavity, a cooling connector, an intermediate conduction layer formed between the at least one cavity cooler and the at least one accelerator cavity configured to facilitate thermal conductivity between the cavity cooler and the accelerator cavity, a mechanical support connected to the accelerator cavity via at least one endplate and configured for stabilizing the accelerator cavity, and a refrigeration source for providing refrigerant via the cooling connector to the at least one cavity cooler.

In an embodiment, the intermediate conduction layer is configured of a ductile material comprising one of indium and lead.

In an embodiment, the cooling connector has a minimum thermal conductivity of $1\times10^4$ W $m^{-1}$ $K^{-1}$ at temperatures of 4 degrees K.

In another embodiment, the mechanical support comprises at least one of a plurality of support rods and a solid cylinder.

In an embodiment, the refrigeration source further comprises a vessel containing a cryogenic fluid.

In another embodiment, the system further comprises a cold tip associated with the refrigeration source clamped to the cooling connector wherein the clamp provides a thermal conductor between the refrigeration source and the cooling connector. A thermal resistance between the cooling connector and cold tip is no more than 10% of a thermal resistance of the cooling connector thereby providing efficient conduction of heat from the cooling connector to the refrigeration source.

In yet another embodiment, an accelerator comprises at least one accelerator cavity, an electron gun, at least one cooling ring, and a refrigeration source for providing refrigerant via the cooling ring to the at least one cooling ring.

In an embodiment, the accelerator further comprises at least one cooling strip for connecting the cooling ring to the accelerator cavity and at least one cooling bar connected to the at least one cooling strip. In an embodiment, the cooling ring is applied to the accelerator through one of direct casting, diffusion boding, and mechanical clamping.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. An accelerator comprising:

a superconducting radio frequency cavity comprising a plurality of cells;

an electron gun incorporated in a first of the plurality of cells of the superconducting radio frequency cavity; and an injection locked magnetron configured as a microwave power source for the electron gun.

2. The accelerator of claim 1 further comprising:

a cathode associated with the electron gun.

3. The accelerator of claim 2 wherein the cathode comprises:

a thermionic cathode configured to have a heat load of less than 0.1 Watts at 4.5 degrees Kelvin.

4. The accelerator of claim 2 wherein the cathode comprises:

a Field Emission cathode.

5. The accelerator of claim 4 wherein the Field Emission cathode comprises:

a cold Field Emission electron cathode further comprising an array of metallic nanowires.

6. The accelerator of claim 5 wherein the array of metallic nanowires comprise nickel nanowires.

7. The accelerator of claim 5 wherein the array of metallic nanowires comprise niobium nanowires.

8. The accelerator of claim 4 wherein the Field Emission cathode comprises:

a Field Emission electron cathode further comprising an array of carbon nanotubes.

9. The accelerator of claim 4 wherein the Field Emission cathode comprises:

a Field Emission electron cathode further comprising nano-diamonds.

10. The accelerator of claim 9 wherein the Field Emission cathode comprising nano-diamonds further comprises:

nitrogen-incorporated ultra-nano-crystalline diamond formed in a film.

11. The accelerator of claim 10 further comprising:

a molybdenum on stainless steel base upon which the nitrogen incorporated ultra-nano-crystalline diamond film is formed.

* * * * *